US011694516B2

(12) United States Patent
Bolling, Jr.

(10) Patent No.: US 11,694,516 B2
(45) **Date of Patent: *Jul. 4, 2023**

(54) CONTROLLED RETURN TO PLAYER IN A SKILL-BASED WAGERING GAME

(71) Applicant: Aristocrat Technologies Australia Pty Limited, North Ryde (AU)

(72) Inventor: T. Grant Bolling, Jr., Reno, NV (US)

(73) Assignee: Aristocrat Technologies Australia Pty Limited, North Ryde (AU)

( * ) Notice: Subject to any disclaimer, the term of this patent is extended or adjusted under 35 U.S.C. 154(b) by 0 days.

This patent is subject to a terminal disclaimer.

(21) Appl. No.: 17/819,514

(22) Filed: Aug. 12, 2022

(65) Prior Publication Data

US 2022/0383701 A1 Dec. 1, 2022

Related U.S. Application Data

(60) Continuation of application No. 17/011,368, filed on Sep. 3, 2020, now Pat. No. 11,430,297, which is a division of application No. 16/006,507, filed on Jun. 12, 2018, now Pat. No. 10,796,529.

(51) Int. Cl.
*G07F 17/32* (2006.01)
*G07F 17/34* (2006.01)

(52) U.S. Cl.
CPC ..... *G07F 17/3262* (2013.01); *G07F 17/3213* (2013.01); *G07F 17/34* (2013.01)

(58) Field of Classification Search
CPC ..... G07F 17/34
See application file for complete search history.

(56) References Cited

U.S. PATENT DOCUMENTS

| | | | | |
|---|---|---|---|---|
| 5,342,049 | A | 8/1994 | Wichinsky | |
| 5,882,258 | A | 3/1999 | Kelly | |
| 6,007,426 | A | 12/1999 | Kelly | |
| 6,488,580 | B1 | 12/2002 | Robb | |
| 6,942,571 | B1 | 9/2005 | McAllister | |
| 7,727,064 | B1 | 6/2010 | Luciano, Jr. | |
| 10,699,517 | B1 * | 6/2020 | Berman | G07F 17/3213 |
| 2003/0027619 | A1 | 2/2003 | Nicastro | |
| 2007/0054728 | A1 | 3/2007 | Hood | |
| 2008/0311980 | A1 | 12/2008 | Cannon | |
| 2009/0061999 | A1 | 3/2009 | Popovich | |
| 2009/0239662 | A1 | 9/2009 | Bramble | |
| 2010/0160030 | A1 | 6/2010 | Indrakumar | |
| 2011/0009178 | A1 | 1/2011 | Gerson | |
| 2011/0218035 | A1 | 9/2011 | Thomas | |
| 2011/0294561 | A1 | 12/2011 | Shaw | |

(Continued)

OTHER PUBLICATIONS

Notice of Allowance dated May 6, 2020 for U.S. Appl. No. 16/006,507 (pp. 1-13).

(Continued)

*Primary Examiner* — Robert T Clarke, Jr.
(74) *Attorney, Agent, or Firm* — Armstrong Teasdale LLP

(57) ABSTRACT

A reel-based electronic gaming system, electronic gaming device, and electronic wagering game in which a player is provided one or more player actions during the course of play. The player actions allow the player to alter an active play area in a variety of ways. The system controls the return to player based on potential user actions and their associated potential outcomes.

20 Claims, 11 Drawing Sheets

(56) References Cited

U.S. PATENT DOCUMENTS

| | | | |
|---|---|---|---|
| 2011/0300937 | A1 | 12/2011 | Crowder, Jr. |
| 2013/0252708 | A1 | 9/2013 | Englman |
| 2013/0281171 | A1 | 10/2013 | Ramsour |
| 2014/0011567 | A1 | 1/2014 | Penacho |
| 2016/0343211 | A1 | 11/2016 | Graboyes Goldman |
| 2017/0084129 | A1 | 3/2017 | Baerlocher |
| 2017/0103609 | A1 | 4/2017 | Plowman |
| 2017/0301178 | A1 | 10/2017 | Thomas |
| 2019/0259242 | A1 | 8/2019 | Bryce |

OTHER PUBLICATIONS

Wikipedia article "Bejeweled", 3 pages.
Wikipedia article "Candy Crush Saga", 8 pages.
Notice of Allowance dated Jun. 18, 2020 for U.S. Appl. No. 16/006,507 (pp. 1-5).
Office Action dated Jul. 9, 2021 for U.S. Appl. No. 16/822,785 (pp. 1-10).
Office Action (Notice of Allowance and Fees Due (PTOL-85)) dated Sep. 21, 2021 for U.S. Appl. No. 16/822,785 (pp. 1-8).
Office Action (Non-Final Rejection) dated Sep. 30, 2021 for U.S. Appl. No. 16/843,575 (pp. 1-5).
Office Action (Notice of Allowance and Fees Due (PTOL-85)) dated May 9, 2022 for U.S. Appl. No. 17/011,368 (pp. 1-9).
Office Action (Notice of Allowance and Fees Due (PTOL-85)) dated Feb. 25, 2022 for U.S. Appl. No. 16/843,575 (pp. 1-8).
Office Action (Notice of Allowance and Fees Due (PTOL-85)) dated Jun. 8, 2022 for U.S. Appl. No. 16/843,575 (pp. 1-2).

* cited by examiner

CONTROLLED RETURN TO PLAYER IN A SKILL-BASED WAGERING GAME

CROSS REFERENCE TO RELATED APPLICATIONS

This application is a continuation of and claims priority to U.S. patent application Ser. No. 17/011,368, filed Sep. 3, 2020, which is a divisional of and claims priority to U.S. patent application Ser. No. 16/006,507, filed Jun. 12, 2018, and granted as U.S. Pat. No. 10,796,529, the entire contents of which are hereby incorporated by reference.

BACKGROUND

The field of disclosure relates generally to electronic gaming, and more particularly to systems and methods for playing a skill-based electronic wagering game, in which a player is allowed to swap a symbol (or symbols) into an initial combination of symbols to create a modified combination of symbols, and in which an average return to player (RTP) is controlled.

Electronic gaming machines (EGMs), or gaming devices, provide a variety of wagering games such as, for example, and without limitation, slot games, video poker games, video blackjack games, roulette games, video bingo games, keno games, and other types of games that are frequently offered at casinos and other locations. Play on EGMs typically involves a player establishing a credit balance by inserting or otherwise submitting money and placing a monetary wager (deducted from the credit balance) on one or more outcomes of an instance, or play, of a primary game, sometimes referred to as a base game. In many games, a player may qualify for secondary games or bonus rounds by attaining a certain winning combination or other triggering event in the base game. Secondary games provide an opportunity to win additional game instances, credits, awards, jackpots, progressives, etc. Awards from any winning outcomes are typically added back to the credit balance and can be provided to the player upon completion of a gaming session or when the player wants to "cash out."

Slot games are often displayed to the player in the form of various symbols arranged in a row-by-column grid, or "matrix." Specific matching combinations of symbols along predetermined paths, or paylines, drawn through the matrix indicate the outcome of the game. The display typically highlights winning combinations and outcomes for ready identification by the player. Matching combinations and their corresponding awards are usually shown in a "paytable" that is available to the player for reference. Often, the player may vary his/her wager to include differing numbers of paylines and/or the amount bet on each line. By varying the wager, the player may sometimes alter the frequency or number of winning combinations, the frequency or number of secondary games, and/or the amount awarded.

Typical games use a random number generator (RNG) to randomly determine the outcome of each game. The game is designed to return a certain percentage of the amount wagered back to the player, referred to as return to player (RTP), over the course of many plays or instances of the game. The RTP and randomness of the RNG are fundamental to ensuring the fairness of the games and are therefore highly regulated. The RNG may be used to randomly determine the outcome of a game and symbols may then be selected that correspond to that outcome. Alternatively, the RNG may be used to randomly select the symbols whose resulting combinations determine the outcome.

BRIEF DESCRIPTION

In one aspect, an electronic gaming system is provided. The electronic gaming system includes a display configured to display a wagering game, a player input interface configured to receive a player input, a credit input mechanism for receiving a monetary input to establish a credit balance for play of the wagering game, and game controller for executing the wagering game by performing operations including: (i) receiving a wager from the player for play of the wagering game; wherein the wager is deducted from the credit balance; (ii) selecting an initial symbol combination from a pool of initial symbol combinations during the wagering game, the initial symbol combination including a matrix of active symbols and an inactive symbol, the pool of initial symbol combinations having been preselected such that the aggregate outcomes of the pool satisfies a configured return-to-player (RTP) for the wagering game; (iii) displaying the plurality of active symbols in an active play area and the inactive symbol in an inactive display position; (iv) receiving a player input indicating an active symbol displayed in the active play area to be replaced by the inactive symbol; (v) replacing the indicated active symbol with the inactive symbol, resulting in an altered active play area; and (vi) evaluating an outcome of the wagering game based on the altered active play area.

In another aspect, a method for providing a wagering game on an electronic gaming system is provided. The method includes the steps of: (i) receiving a wager from a player for play of the wagering game; wherein the wager is deducted from a credit balance established for play of the wagering game; (ii) selecting an initial symbol combination from a pool of initial symbol combinations during the wagering game, the initial symbol combination including a matrix of active symbols and an inactive symbol, the pool of initial symbol combinations having been preselected such that the aggregate outcomes of the pool satisfies a configured return-to-player (RTP) for the wagering game; (iii) displaying the plurality of active symbols in an active play area and the inactive symbol in an inactive display position; (iv) receiving a player input indicating an active symbol displayed in the active play area to be replaced by the inactive symbol; (v) replacing the indicated active symbol with the inactive symbol, resulting in an altered active play area; and (vi) evaluating an outcome of the wagering game based on the altered active play area.

In yet another aspect, a method for providing a wagering game on an electronic gaming system is provided. The method includes the steps of: (i) providing an active play area and an inactive display position as part of the wagering game; the active play area including a matrix of display positions for displaying a plurality of active symbols; the inactive display position for displaying an inactive symbol, the inactive symbol being configured to replace an active symbol of the plurality of active symbols in the active play area in response to a player input; (ii) selecting, by a game controller, the plurality of active symbols for display as part of the wagering game; (iii) displaying the plurality of active symbols on the active play area; (iv) determining a target win range for the wagering game that, over time and in aggregate with outcomes of other wagering games provided by the electronic gaming system, contributes to satisfying a configured return-to-player (RTP) of the electronic gaming system; (v) selecting, by the game controller, the inactive symbol to display in the inactive display position as part of the wagering game by (a) determining potential outcomes for each possible replacement of the displayed plurality of active symbols by the inactive symbol, and (b) ensuring the determined potential outcomes satisfy the target win range; (vi) displaying, by the game controller, the selected inactive symbol in the inactive display position; (vii) receiving the player input as part of the wagering game, the player input indicating which displayed active symbol is to be replaced by the inactive symbol; (viii) replacing the indicated active symbol in the active play area with the inactive symbol in response to the player input, resulting in an altered active play area; and (ix) evaluating, by the game controller, an outcome of the wagering game based on the altered active play area.

BRIEF DESCRIPTION OF THE DRAWINGS

An example embodiment of the subject matter disclosed will now be described with reference to the accompanying drawings.

DETAILED DESCRIPTION

The subject matter of the present disclosure relates to a skill-based electronic wagering game and electronic gaming machine in which a player is provided an opportunity to alter an active play area based on a player-initiated action. For example, the player may be allowed to rotate a reel, to swap the positions of two reels, or to swap an active symbol in the active play area with an inactive symbol (e.g., an off-reel symbol displayed near the reels). The wagering game controls a return to player (or "RTP," as described below) based on the possible actions allowed by the player. For example, a player may be provided one or more symbol swapping options from a plurality of options associated with the desired RTP, and the player may refer to a paytable of the wagering game prior to selecting one of the options. The player-initiated actions allow the player to potentially improve the outcome of the game over an initial spin of the reels. The selection based on the paytable contributes a skill-based gameplay component to the wagering game that also provides additional excitement to the player.

In some example wagering games and electronic gaming machines and associated systems and methods described herein, "virtual reels" are utilized. Such virtual reels may be used to simulate aspects of conventional mechanical reels, but provide certain flexibilities that allow operations not feasible with mechanical reels. In some embodiments, a simulation of reels spinning may be displayed during wagering games. Such simulation, in some embodiments, may include determining a stop position for each of several virtual reels during a simulated spin (e.g., constrained by a stored structure defining each virtual reel), while in other embodiments, such simulation may include determining which symbols appear in each active display position (e.g., unconstrained by such structure). The term "reels," as used herein, and unless otherwise specified, refers to virtual or simulated reels and not conventional mechanical reels.

As used herein, return to player ("RTP"), or average RTP, refers to a percentage of all wagered currency that a wagering game will return, on average, to players of the wagering game over a period of time (e.g., over the lifetime of the wagering game). For example, a wagering game associated with an average RTP of 85% may return approximately 85% of all wagered currency to players of the wagering game over a period of time.

Figure 1:
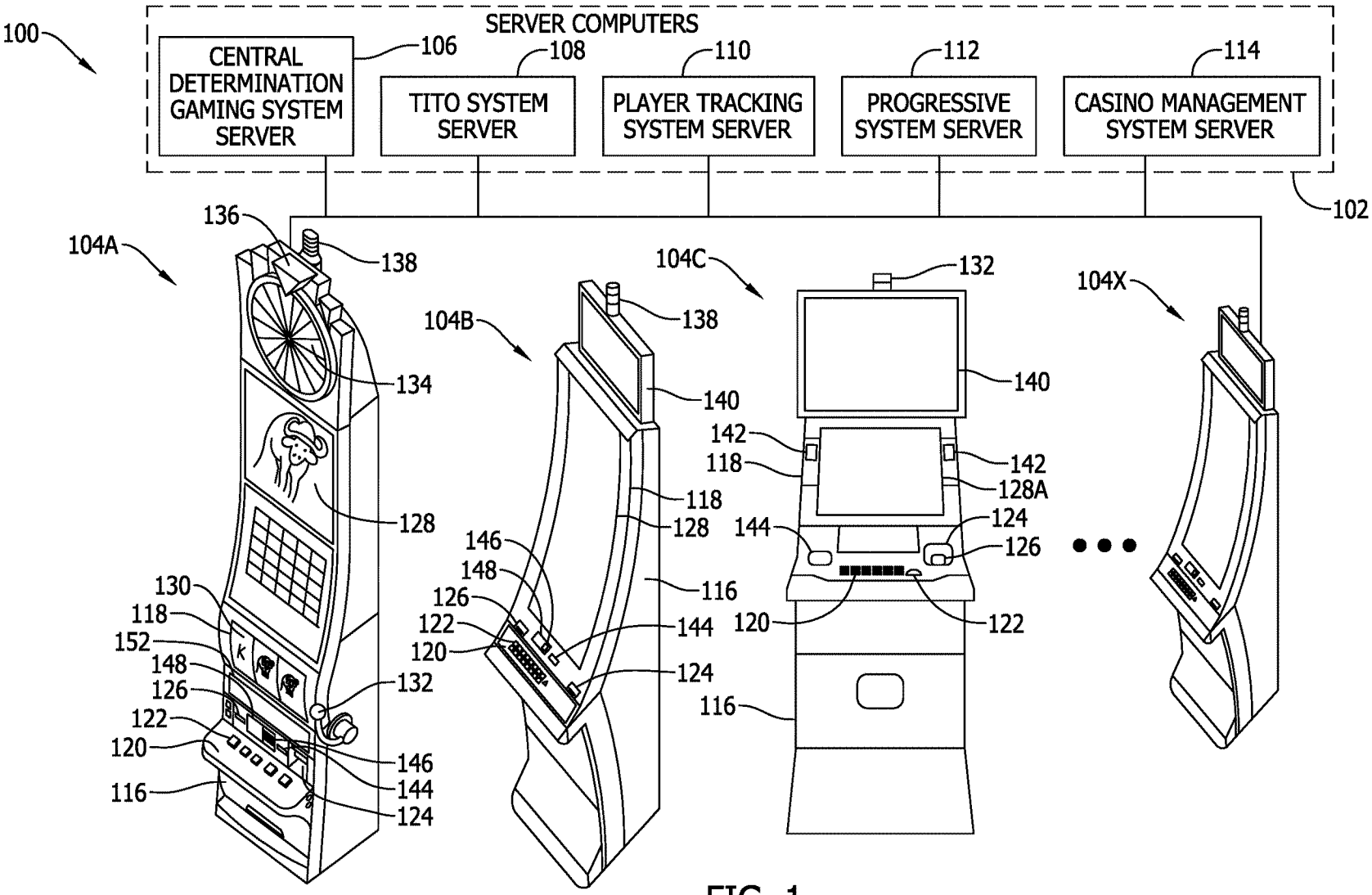
FIG. 1 is a diagram of exemplary EGMs networked with various gaming-related servers.

FIG. 1 is a diagram of exemplary EGMs networked with various gaming-related servers in a gaming system 100. Gaming system 100 operates in a gaming environment, including one or more servers, or server computers, such as slot servers of a casino, that are in communication, via a communications network, with one or more EGMs, or gaming devices 104A-104X, such as EGMs, slot machines, video poker machines, or bingo machines, for example. Gaming devices 104A-104X may, in the alternative, be portable and/or remote gaming devices such as, for example, and without limitation, a smart phone, a tablet, a laptop, or a game console.

Communication between gaming devices 104A-104X and servers 102, and among gaming devices 104A-104X, may be direct or indirect, such as over the Internet through a web site maintained by a computer on a remote server or over an online data network including commercial online service providers, Internet service providers, private networks, and the like. In other embodiments, gaming devices 104A-104X communicate with one another and/or servers 102 over wired or wireless RF or satellite connections and the like.

In certain embodiments, servers 102 may not be necessary and/or preferred. For example, the present invention may, in one or more embodiments, be practiced on a stand-alone gaming device such as gaming device 104A and/or gaming device 104A in communication with only one or more other gaming devices 104B-104X (i.e., without servers 102).

Servers 102 may include a central determination gaming system server 106, a ticket-in-ticket-out (TITO) system server 108, a player tracking system server 110, a progressive system server 112, and/or a casino management system server 114. Gaming devices 104A-104X may include features to enable operation of any or all servers for use by the player and/or operator (e.g., the casino, resort, gaming establishment, tavern, pub, etc.). For example, a game outcome may be generated on a central determination gaming system server 106 and then transmitted over the network to any of a group of remote terminals or remote gaming devices 104A-104X that utilize the game outcome and display the result to the player.

Gaming device 104A is often of a cabinet construction that may be aligned in rows or banks of similar devices for placement and operation on a casino floor. The gaming device 104A often includes a main door 116 that provides access to the interior of the cabinet. Gaming device 104A typically includes a button area or button deck 120 accessible by a player that is configured with input switches or buttons 122, a bill validator 124, and/or ticket-out printer 126.

In FIG. 1, gaming device 104A is shown as a Relm XL™ model gaming device manufactured by Aristocrat® Technologies, Inc. As shown, gaming device 104A is a reel machine having a gaming display area 118 including a plurality of mechanical reels 130, typically 3 or 5 mechanical reels, with various symbols displayed thereon. Reels 130 are then independently spun and stopped to show a set of symbols within the gaming display area 118 that may be used to determine an outcome to the game.

In many configurations, gaming machine 104A may have a main display 128 (e.g., video display monitor) mounted to, or above, gaming display area 118. Main display 128 may be, for example, a high-resolution LCD, plasma, LED, or OLED panel that may be flat or curved as shown, a cathode ray tube, or other conventional electronically controlled video monitor.

In certain embodiments, bill validator 124 may also function as a "ticket-in" reader that enables the player to use a casino-issued credit ticket to load credits onto gaming device 104A (e.g., in a cashless TITO system). In such cashless embodiments, gaming device 104A may also include a "ticket-out" printer 126 for outputting a credit ticket when a "cash out" button is pressed. Cashless ticket systems are well known in the art and are used to generate and track unique bar-codes printed on tickets to allow players to avoid the use of bills and coins by loading credits using a ticket reader and cashing out credits using ticket-out printer 126 on gaming device 104A.

In certain embodiments, a player tracking card reader 144, a transceiver for wireless communication with a player's smartphone, a keypad 146, and/or an illuminated display 148 for reading, receiving, entering, and/or displaying player tracking information can be provided. In such embodiments, a game controller within gaming device 104A communicates with player tracking server system 110 to send and receive player tracking information.

Gaming device 104A may also include, in certain embodiments, a bonus topper wheel 134. When bonus play is triggered (e.g., by a player achieving a particular outcome or set of outcomes in the primary game), bonus topper wheel 134 is operative to spin and stop with indicator arrow 136 indicating the outcome of the bonus game. Bonus topper wheel 134 is typically used to play a bonus game, but could also be incorporated into play of the base game, or primary game.

A candle 138 may be mounted on the top of gaming device 104A and may be activated by a player (e.g., using a switch or one of buttons 122) to indicate to operations staff that gaming device 104A has experienced a malfunction or the player requires service. The candle 138 is also often used to indicate a jackpot has been won and to alert staff that a hand payout of an award may be needed.

In certain embodiments, there may also be one or more information panels 152 that may be, for example, a back-lit silkscreened glass panel with lettering to indicate general game information including, for example, a game denomination (e.g., $0.25 or $1), pay lines, pay tables, and/or various game related graphics. In some embodiments, information panels 152 may be implemented as an additional video display.

Gaming device 104A traditionally includes a handle 132 typically mounted to the side of main cabinet 116 that may be used to initiate game play.

Figure 2:
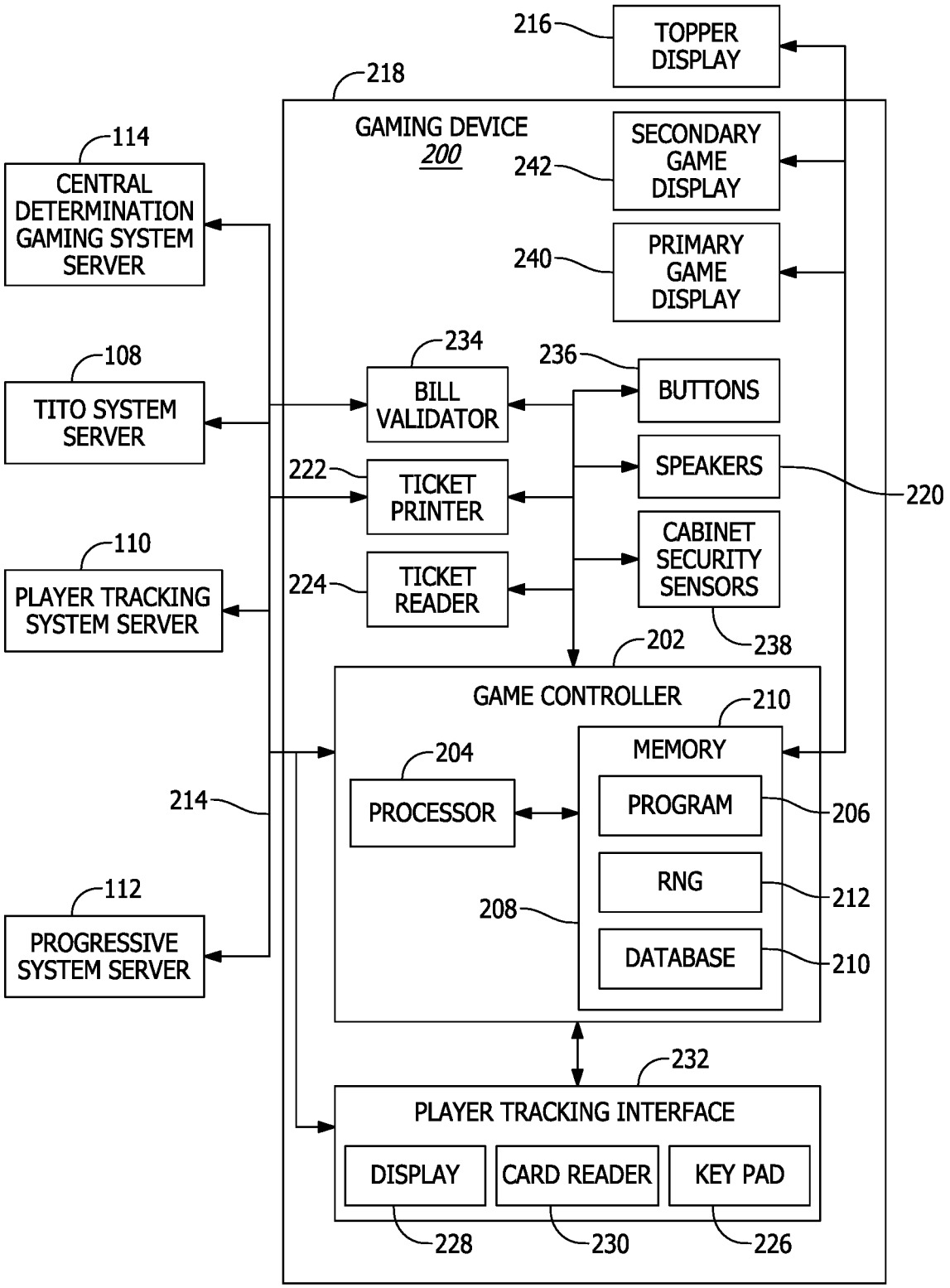
FIG. 2 is a block diagram of an exemplary electronic gaming device.

Many or all of the above described components may be controlled by circuitry (e.g., a gaming controller) housed inside main cabinet 116 of gaming device 104A, the details of which are shown in FIG. 2.

Not all gaming devices suitable for implementing embodiments of the gaming systems, gaming devices, or methods described herein necessarily include top wheels, top boxes, information panels, cashless ticket systems, and/or player tracking systems. Further, some suitable gaming devices have only a single game display that includes only a mechanical set of reels and/or a video display, while others are designed, for example, for bar tables or table tops and have displays that face upwards.

Exemplary gaming device 104B shown in FIG. 1 is an Arc™ model gaming device manufactured by Aristocrat® Technologies, Inc. Where possible, reference numerals identifying similar features of gaming device 104A are also identified in gaming device 104B using the same reference numerals. Gaming device 104B, however, does not include mechanical reels 130 and instead shows game play and related game play functions on main display 128. An optional topper screen 140 may be included as a secondary game display for bonus play, to show game features or attraction activities while the game is not in play, or any other information or media desired by the game designer or operator. In some embodiments, topper screen 140 may also or alternatively be used to display progressive jackpot prizes available to a player during play of gaming device 104B.

Gaming device 104B includes main cabinet 116 having main door 118 that opens to provide access to the interior of gaming device 104B. Main door 118, or service door, is typically used by service personnel to refill ticket-out printer 126 and collect bills and tickets inserted into bill validator 124. Main door 118 may further be accessed to reset the machine, verify and/or upgrade the software, and for general maintenance operations.

Exemplary gaming device 104C shown in FIG. 1 is a Helix™ model gaming device manufactured by Aristocrat® Technologies, Inc. Gaming device 104C includes a main display 128A that is in a landscape orientation. Although not illustrated by the front view illustrated in FIG. 1, landscape display 128A has a curvature radius from top to bottom. In certain embodiments, display 128A is a flat panel display. Main display 128A is typically used for primary game play while a secondary display 128B is used for bonus game play, to show game features or attraction activities while the game is not in play, or any other information or media desired by the game designer or operator.

Many different types of games, including mechanical slot games, video slot games, video poker, video black jack, video pachinko, keno, bingo, and lottery, may be provided with or implemented within gaming devices 104A-104C and other similar gaming devices. Each gaming device may also be operable to provide many different games. Games may be differentiated according to themes, sounds, graphics, type of game (e.g., slot game vs. card game vs. game with aspects of skill), denomination, number of paylines, maximum jackpot, progressive or non-progressive, bonus games, Class II, or Class III, etc.

FIG. 2 is a block diagram of an exemplary gaming device 200, or EGM, connected to various external systems, including TITO system server 108, player tracking system server 110, progressive system server 112, and casino management system server 114. All or parts of gaming device 200 may be embodied in game devices 104A-104X shown in FIG. 1. The games conducted on gaming device 200 are controlled by a game controller 202 that includes one or more processors 204 and a memory 208 coupled thereto. Games are represented by game software or a game program 206 stored on memory 208. Memory 208 includes one or more mass storage devices or media housed within gaming device 200. One or more databases 210 may be included in one or more databases 210 for use by game program 206. A random number generator (RNG) 212 is implemented in hardware and/or software and is used, in certain embodiments, to generate random numbers for use in operation of gaming device 200 to conduct game play and to ensure the game play outcomes are random and meet regulations for a game of chance.

Alternatively, a game instance, or round of play of the game, may be generated on a remote gaming device such as central determination gaming system server 106, shown in FIG. 1. The game instance is communicated to gaming device 200 via a network 214 and is then displayed on gaming device 200. Gaming device 200 executes game software to enable the game to be displayed on gaming device 200. In certain embodiments, game controller 202 executes video streaming software that enables the game to be displayed on gaming device 200. Game software may be loaded from memory 208, including, for example, a read only memory (ROM), or from central determination gaming system server 106 into memory 208. Memory 208 includes at least one section of ROM, random access memory (RAM), or other form of storage media that stores instructions for execution by processor 204.

Gaming device 200 includes a topper display 216. In an alternative embodiment, gaming device 200 includes another form of a top box such as, for example, a topper wheel, or other topper display that sits on top of main cabinet 218. Main cabinet 218 or topper display 216 may also house various other components that may be used to add features to a game being played on gaming device 200, including speakers 220, a ticket printer 222 that prints bar-coded tickets, a ticket reader 224 that reads bar-coded tickets, and a player tracking interface 232*a*. Player tracking interface 232*a* may include a keypad 226 for entering player tracking information, a player tracking display 228 for displaying player tracking information (e.g., an illuminated or video display), a card reader 230 for receiving data and/or communicating information to and from media or a device such as a smart phone enabling player tracking. Ticket printer 222 may be used to print tickets for TITO system server 108. Gaming device 200 may further include a bill validator 234, buttons 236 for player input, cabinet security sensors 238 to detect unauthorized opening of main cabinet 218, a primary game display 240, and a secondary game display 242, each coupled to and operable under the control of game controller 202.

Gaming device 200 may be connected over network 214 to player tracking system server 110. Player tracking system server 110 may be, for example, an OASIS® system manufactured by Aristocrat® Technologies, Inc. Player tracking system server 110 is used to track play (e.g., amount wagered and time of play) for individual players so that an operator may reward players in a loyalty program. The player may use player tracking interface 232*a* to access his/her account information, activate free play, and/or request various information. Player tracking or loyalty programs seek to reward players for their play and help build brand loyalty to the gaming establishment. The rewards typically correspond to the player's level of patronage (e.g., to the player's playing frequency and/or total amount of game plays at a given casino). Player tracking rewards may be complimentary and/or discounted meals, lodging, entertainment and/or additional play. Player tracking information may be combined with other information that is now readily obtainable by casino management system server 114.

Gaming devices, such as gaming devices 104A-104X and 200, are highly regulated to ensure fairness and, in many cases, gaming devices 104A-104X and 200 are operable to award monetary awards (e.g., typically dispensed in the form of a redeemable voucher). Therefore, to satisfy security and regulatory requirements in a gaming environment, hardware and software architectures are implemented in gaming devices 104A-104X and 200 that differ significantly from those of general-purpose computers. Adapting general purpose computers to function as gaming devices 200 is not simple or straightforward because (1) regulatory requirements for gaming devices, (2) harsh environments in which gaming devices operate, (3) security requirements, and (4) fault tolerance requirements. These differences require substantial engineering effort and often additional hardware.

When a player wishes to play gaming device 200, he/she can insert cash or a ticket voucher through a coin acceptor (not shown) or bill validator 234 to establish a credit balance on the gaming machine. The credit balance is used by the player to place wagers on instances of the game and to receive credit awards based on the outcome of winning instances of the game. The credit balance is decreased by the amount of each wager and increased upon a win. The player can add additional credits to the balance at any time. The player may also optionally insert a loyalty club card into card reader 230. During the game, the player views the game outcome on game displays 240 and 242. Other game and prize information may also be displayed.

For each game instance, a player may make selections that may affect play of the game. For example, the player may vary the total amount wagered by selecting the amount bet per line and the number of lines played. In many games, the player is asked to initiate or select options during course of game play (such as spinning a wheel to begin a bonus round or select various items during a feature game). The player may make these selections using player-input buttons 236, primary game display 240, which may include a touch screen, or using another suitable device that enables a player to input information into gaming device 200.

During certain game events, gaming device 200 may display visual and auditory effects that can be perceived by the player. These effects add to the excitement of a game, which makes a player more likely to continue playing.

Auditory effects include various sounds that are projected by speakers 220. Visual effects include flashing lights, strobing lights, or other patterns displayed from lights on gaming device 200 or from lights behind information panel 152, shown in FIG. 1.

When the player wishes to stop playing, he/she cashes out the credit balance (typically by pressing a cash out button to receive a ticket from ticket printer 222). The ticket may be "cashed-in" for money or inserted into another machine to establish a credit balance for play.

Figure 3:
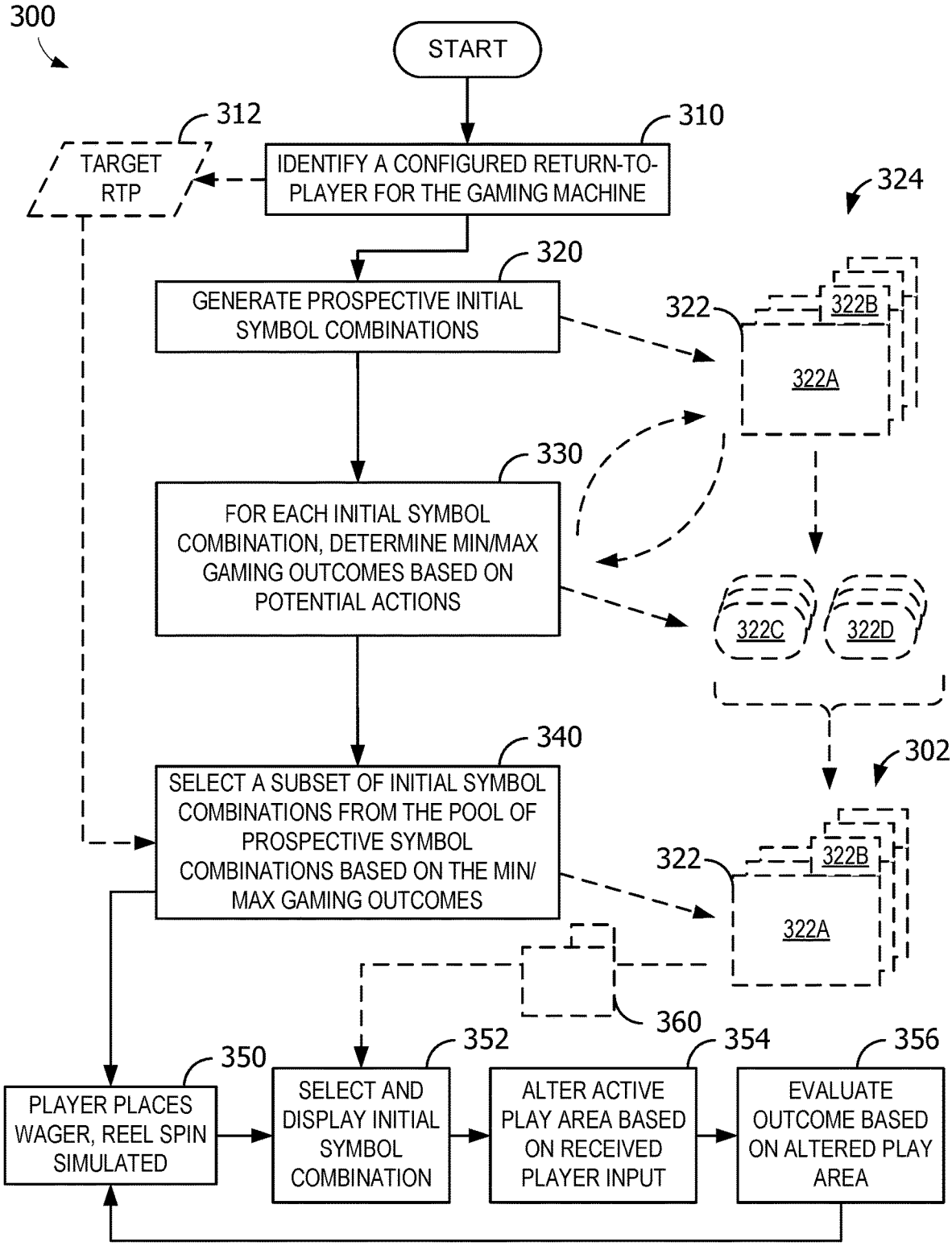
FIG. 3 is a flowchart illustrating an example process and associated data flow for providing a skill-based wagering game, using any of electronic gaming devices shown in FIG. 1, that controls RTP.
Figure 4:
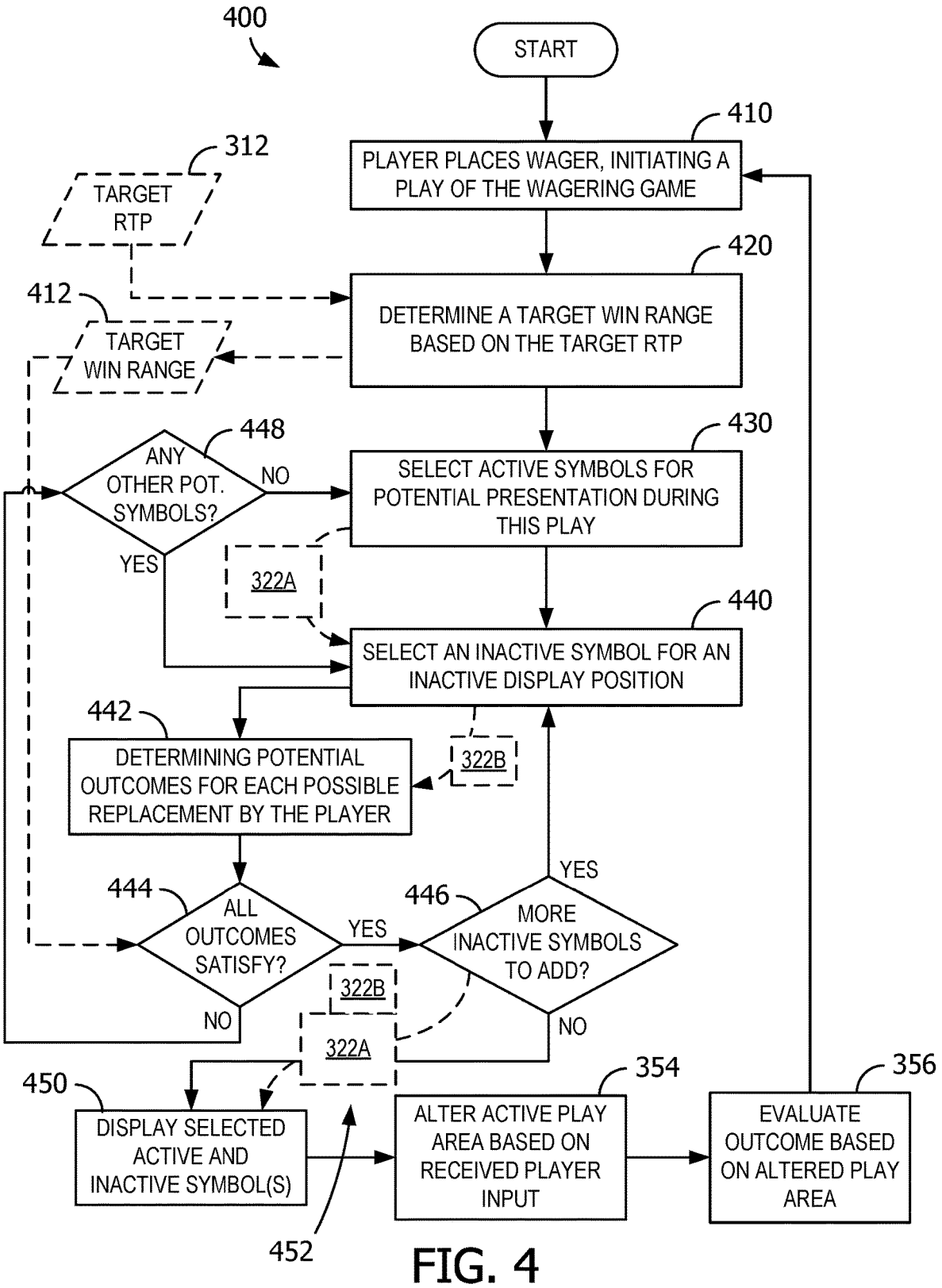
FIG. 4 is a flowchart illustrating another example process and associated data flow for providing a skill-based wagering game, using any of electronic gaming devices shown in FIG. 1, that controls RTP.

FIG. 3 is a flowchart illustrating an example process 300 and associated data flow for providing a skill-based wagering game, using any of electronic gaming devices 104A-104C, that controls RTP. FIG. 4 is a flowchart illustrating another example process 400 and associated data flow for providing a skill-based wagering game, using any of electronic gaming devices 104A-104C, that controls RTP. FIGS. 5, 6A, 6B 7A, 7B, 8A, and 8B are schematic views illustrating various gameplay embodiments in which the player is provided with various types of player-initiated actions, and in which the skill-based wagering game controls RTP. Data flow (e.g., inputs and outputs of various operations) and data elements are generally represented in FIGS. 3 and 4 using broken line.

Referring now to FIG. 3, in some embodiments, processor 204 (and/or a backend server, such as any of servers 108-114) simulates multiple initial symbol combinations and associated possible game outcomes (e.g., all possible game outcomes) of the skill-based wagering game (e.g., prior to game play) based on what the player may do given a particular initial symbol combination. Based on those multiple possible game outcomes, processor 204 selects a subset of initial symbol combinations that result in game outcomes that, collectively, satisfy a desired (or "target") RTP 312. In some embodiments, processor 204 may simulate the plurality of potential game outcomes at one or more predetermined and/or scheduled times, such as, for example, when the wagering game is initially configured on a gaming floor and/or when the wagering game is reconfigured on the gaming floor. In addition, where a backend server performs the simulation function, the server may periodically simulate the plurality of possible game outcomes, such as at one or more scheduled dates and/or times. Further, in the case that a backend server performs the simulation function, the server may periodically transmit the first plurality of symbol combinations to processor 204 for storage in memory 103 (e.g., in a XML format).

In various example embodiments described herein, the player is provided with one or more player-initiated actions that may be performed during game play, such as rotating a reel, swapping two reels, swapping two symbols within the active play area, swapping two symbols across multiple different active play areas (e.g., between two games being contemporaneously played on the same EGM, such as between a primary game and a bonus game, or between two bonus games), or replacing active symbol(s) with inactive symbol(s) that are presented outside the active play area (e.g., moving the inactive symbol into an active position on one of the reels). This player-initiated action is configured to allow the player to potentially alter the active play area in some way during game play (e.g., via a player input, such as through a touch screen display) and, as such, potentially alter the outcome of the wagering game (e.g., possibly improving a credit award given to the player by adding more or different line wins).

During simulation, and like actual game play, the initial symbol combination in the active play area may be modified by the player during gameplay by one or more player-initiated actions. In some examples, the wagering game may provide a player-initiated action that allows the player to rotate one or more of the reels by one or more positions (e.g., causing the symbols in the active play area to change based on the reel rotation). In other examples, the wagering game may provide a player-initiated action that allows the player to swap the positions of two reels (e.g., causing the symbols in the active play area to switch positions). In still other examples, the wagering game may provide an inactive symbol (e.g., apart from the reels) and may provide a player-initiated action that allows the player to move the inactive symbol into the active play area (e.g., thereby replacing or "overlaying" a symbol position with the inactive symbol, thereby making the inactive symbol active). In some embodiments, the wagering game may allow the player to elect to make no change to the initial symbol combination. In such a case, the player-initiated action is to accept the initial symbol combination as initially presented (e.g., without performing a reel rotation, a reel swap, a symbol swap). As such, each player-initiated action may alter the symbols appearing in the active play area, thereby potentially altering the outcome of the wagering game. As used herein, the phrases "modified combination of symbols" or "modified symbol combination" refer to the symbols appearing in the active play area after a player-initiated action is performed. In some situations and in some embodiments, the modified symbol combination may be the same as the initial symbol combination. As such, processor 204 may simulate each potential user action for each prospective spin.

As used herein, the phrases "initial symbol combination" or "initial combination of symbols" may be used to refer to a combination of symbols presented to a player at the beginning or start of the wagering game in an active play area, and possibly symbols presented in one or more inactive display positions (e.g., as the result of an "initial spin" in response to a wager, where placement of the wager initiates the wagering game). For example, the initial spin of a set of reels exposes the initial symbol combination in the active play area based on the real or simulated final resting position of each of the reels. The term modifier "prospective" may be used to refer to game aspects that are used during simulation (e.g., not yet appearing to the player). When presented to the player at the start of the wagering game, or during simulation when analyzing a particular prospective spin, the initial symbol combination has not yet been modified (e.g., by a player-initiated action), and thus may be referred to as an "initial" symbol combination.

More specifically, and as shown in FIG. 3, a method 300 includes various example operations used to generate a pool 302 of initial symbol combinations 322 that, when used during game play, collectively satisfy the desired RTP 312 over time. In other words, and as described in detail below, processor 204 chooses a subset of initial symbol combinations 322 whose possible game outcomes, collectively, satisfy the desired RTP 312 in the wagering game, such as satisfying a minimum RTP (e.g., to satisfy casino gaming requirements) or a maximum RTP (e.g., based on casino preference). As such, satisfying RTP 312 may include satisfying a minimum RTP, a maximum RTP, or an RTP range (e.g., between the minimum RTP and the maximum RTP). RTP 312 may generally be configured for a particular EGM, or for a particular game within an EGM. The term "target RTP" may be used herein to refer to the configured RTP for the EGM or for the game inasmuch as the configured RTP represents a target to be satisfied by the various outcomes of the wagering game in aggregate over time.

In the example embodiment, processor 204 identifies target RTP 312 of the EGM (operation 310). To satisfy target RTP 312, processor 204 analyzes a pool of various prospective initial symbol combinations 324 in light of how the active play area may be changed by the player during game play by the player performing the player-initiated action in various ways. In the example shown in FIG. 3, each initial symbol combination 322 includes a pairing of an active play area (or "active symbols") 322A and one or more inactive symbols 322B. Active play area 322A represents a matrix of active symbols (e.g., reel spin outcomes) that may be displayed to the player during game play. Inactive symbols 322B represent one or more symbols that may be displayed to the player in inactive display positions outside of the active play area 322A, and that may be used in the player-initiated actions to alter the associated active play area 322A (e.g., based on the type of player-initiated action made available to the player and how the player chooses to execute that action). While this example includes initial symbol combinations 322 having inactive symbols 322B, it should be understood that some player-initiated actions may not utilize inactive symbols (e.g., row swapping), and thus in some embodiments, initial symbol combinations 322 may not include inactive symbols 322B.

To determine the possible game outcomes, processor 204 generates multiple initial symbol combinations 322 (e.g., prospective spin results based on spins of the virtual reels or otherwise selecting symbols for each position in the active play area) (operation 320). To generate active play areas 322A, in the example embodiment, processor 204 may generate all possible reel spins ("initial spins" or "reel stops") of the virtual reels of the wagering game. In other embodiments, processor 204 may randomly generate random play areas 322A (e.g., placing random symbols from a symbol set into random play areas 322A). To generate the associated inactive symbols 322B, in the example embodiment, and for each particular active play area 322A, processor 204 uses each possible permutation and combination of inactive symbols 322B given the number of inactive symbol positions presented during the wagering game and given a set of symbols ("inactive symbol set") used for the inactive symbol positions. For example, and for purposes of simplicity, presume that the wagering game provides one inactive display position and five possible inactive symbols that may appear in that inactive display position. As such, for a particular active play area 322A, processor 204 generates five initial symbol combinations 322, each having that particular active play area 322A and one of the five possible symbols from the inactive symbol set as the inactive symbol 322B. Upon generation of each of the initial symbol combinations 322, processor 204 has thus generated the pool of prospective initial symbol combinations 324.

In the example embodiment, and for each initial symbol combination 322 in the pool of prospective initial symbol combinations 324, processor 204 determines potential outcomes based on the player-initiated actions available to the player (operation 330). More specifically, processor 204 determines one or more of a minimized prospective gaming outcome ("minimized outcome") 322C and a maximized prospective gaming outcome ("maximized outcome") 322D for each initial symbol combination 322. The minimized outcome 322C represents the "worst" gaming outcome (e.g., smallest credit award) achievable by the player when given a particular active play area 322A and associated inactive symbol(s) 322B, and given a set of prospective alterations to the active play area 322A made possible by the player-initiated action(s) provided during the wagering game. In other words, minimized outcome 322C represents the outcome of the player's worst possible move. Similarly, maximized outcome 322D represents the "best" gaming outcome (e.g., largest credit award). In the example embodiment, to determine minimized outcome 322C and maximized outcome 322D, processor 204 analyzes all possible actions and resulting changes to the active play area, and evaluating an outcome of each particular modification (e.g., based on pay tables for the wagering game). For example, if the player is allowed to replace a single active symbol with an inactive symbol from a single inactive display position into any active display position, all possible actions includes separately evaluating the moving of the inactive symbol into one of each of the active display positions. As such, after operation 330, each initial symbol combination 322 in the pool of prospective initial symbol combinations 324 also has an associated minimized outcome 322C and an associated maximized outcome 322D, representing a range of possible outcomes. In some embodiments, only one or the other of the minimized outcome 322C and maximized outcome 322D may be determined.

In the example embodiment, processor 204 selects a subset of initial symbol combinations 322 from the pool of prospective initial symbol combinations 324 based on the target RTP 312 and one or more of the minimized outcomes 322C and maximized outcomes 322D of the initial symbol combinations 322 (operation 340). More specifically, processor 204 selects pool 302 of initial symbol combinations 322 that, collectively, satisfies the configured RTP 312. In some embodiments, processor 204 may select a pre-determined number of initial symbol combinations 322 from pool 324 (e.g., 1,000), so as to provide a pool size sufficient to provide variety of initial symbol outcomes 322 to the player (e.g., so they do not see the same initial symbol combinations 322 reappearing).

In some embodiments, some or all of the initial symbol combinations 322 selected for pool 302 may initially be randomly selected from pool 324 and, if the resultant RTP of that pool 302 does not satisfy target RTP 312 (e.g., is above an upper limit, or is below a lower limit), then processor 204 may alter pool 302 until pool 302 satisfies target RTP 312 (e.g., adding higher-winning initial symbol combinations 322 or removing lower-winning initial symbol combinations from pool 302 if pool 302 is below a lower limit, or adding lower-winning initial symbol combinations or removing higher-winning initial symbol combinations 322 if pool 302 is above an upper limit).

In some embodiments, the initial symbol combinations 322 selected for pool 302 may be selected from groups of initial symbol combinations 322, where initial symbol combinations 322 are grouped based on their associated minimized outcomes 322C or maximized outcomes 322D. For example, processor 204 may group all initial symbol combinations 322 in pool 324 into groups based on their maximized outcomes 322D, such as groups "wins 0", "wins 1-20", "wins 21-50", "wins 51-100", and "wins 100+". The resulting groupings segment initial symbol combinations 322 into groups based on how much the player could possibly win. Some game designers or casino operators may wish to configure game play such that, while still complying with the target RTP 312, the player wins more frequently but in lower amounts, or the player wins less often but in greater amounts. As such, processor 204 may select initial symbol combinations 322 from each of the various groups based on a ratio that approximately satisfies the target RTP 312 (e.g., percentages for each group, as provided by the game designer or the casino operator). As such, pool 302 may then be constructed of initial symbol combinations 322 that conform not only to the target RTP 312, but also may be configured to preferences of game designers or casino operators (e.g., based on player preference). Similarly to the process as above, processor 204 may evaluate the resultant RTP of the pool 302 and alter pool 302 if the resultant RTP does not satisfy the target RTP 312 (e.g., adding or removing initial symbol combinations 322).

During game play, processor 204 provides the wagering game to the player via the EGM. In the example embodiment, operations 350-356 are performed by processor 204 as the player plays the wagering game. More specifically, upon the player placing a wager, processor 204 simulates a reel spin of the virtual reels (operation 350). Before or during the simulated spinning, processor 204 selects an initial symbol combination 360 (e.g., one of the initial symbol combinations 322) from pool 302 (e.g., randomly, based on a random number generator) and displays the selected initial symbol combination 360 to the player (operation 352). More specifically, processor 204 displays the active play area 322A matrix of the selected initial symbol combination 360 in an active play area of the wagering game (not shown in FIG. 3), and may display inactive symbol(s) 322B of the selected initial symbol combination 360 in inactive display position(s), thereby completing the simulated spinning of the virtual reels. As such, the player is then presented with the active play area 322A and inactive symbol(s) 322B and one or more player-initiated actions allowed by the wagering game (e.g., the same player-initiated actions used to generate minimized outcomes 322C and maximized outcomes 322D).

Upon display of the initial symbol combination 360, processor 204 then allows the player to alter the active play area upon player input based on the player-initiated actions made available by the wagering game (operation 354). Such action may alter the play area, thereby resulting in an "altered play area" (e.g., the active play area as changed by the player-initiated action). For example, the wagering game may allow the player to move an inactive symbol into the active play area by dragging and dropping the inactive symbol from an inactive display position into one of the active display positions to replace an active symbol, or rotate a reel to make an inactive symbol shift into the active play area. Any such active area play alteration described herein may be provided by the wagering game at this stage. In some embodiments, the player may be allowed to elect to make no changes at all. Once the player has completed any player-initiated action allowed by the wagering game (or elected not to take any action), then processor 204 evaluates the outcome of the wagering game based on the altered play area (operation 356). In other words, processor 204 evaluates the altered play area using the pay tables configured for the wagering game, calculating a credit award for the player based on any various line wins that may be present.

As such, operation 356 generally represents the conclusion of a single play of the wagering game. Processor 204 may then repeat the wagering game, looping back to operation 350 to begin the wagering game again.

In the example embodiment, upon a use of initial symbol combination 360 from pool 302, processor 204 may exclude that particular initial symbol combination 360 from further use. Since pool 302 was created to yield a particular RTP over time (e.g., calculated based on one play of each of the initial symbol combinations 322 in pool 302), processor 204 eliminates initial symbol combination 360 from further use once it has been used. For example, processor 204 may mark initial symbol combination 360 in pool 302 as having been used, or may remove initial symbol combination 360 from pool 302. As such, pool 302 effectively becomes smaller with each play of the wagering game until pool 302 is exhausted. At that time, processor 204 may construct a new pool 302 (e.g., as described above, looping back to operation 320), or may refresh pool 302, using the same set of initial symbol combinations 360 as originally constructed (e.g., marking all initial symbol combinations 322 in pool 302 as unused, or inserting all of the original initial symbol combinations 322 back into pool 302). Accordingly, such construction and use of the initial symbol combinations 322 in pool 302 ensures that the EGM satisfies the target RTP 312 over time.

Referring now to FIG. 4, in some embodiments, processor 204 (and/or a backend server, such as any of servers 108-114) simulates multiple possible game outcomes of the skill-based wagering game during game play, based on a particular set of active symbols selected during game play, and based on what the player may do when given a player-initiated action and one or more inactive symbols. In the example embodiment, a method 400 includes various example operations used to analyze initial symbol combinations, similar to initial symbol combinations 322, that, when used during game play, collectively satisfy target RTP 312 over time.

In the example embodiment, upon the player placing a wager, processor 204 initiates a play of the wagering game (operation 410). During game play, processor 204 provides an active play area and at least one inactive display position as part of the wagering game. The active play area includes a matrix of display positions for displaying multiple active symbols. The inactive display position(s) are for displaying one or more inactive symbols (e.g., one symbol per inactive display position). The wagering game provides a player-initiated action that allows the player to somehow alter the active play area using the inactive symbol(s), such as by replacing an active symbol in the active play area with one of the inactive symbols from the inactive display positions.

Processor 204 also determines a target win range 412 based on the target RTP 312 (operation 420). Since RTP is generally an aggregate value determined over a period of time, RTP is normally computed based on many game play outcomes. Accordingly, any single game outcome often does not individually satisfy the target RTP 312. As such, for any given single game, processor 204 uses the win range 412 to control a range of potential outcomes for this particular play. Over time, processor 204 satisfies the target RTP 312 based on how win ranges 412 are selected over many games. Win ranges 412 may be selected similar to the percentages for the groupings of initial symbol combinations 322 described above with respect to FIG. 3. Using the above example groupings, the EGM may be configured with percentages for each grouping that, over time, satisfy the target RTP 312. For example, for a set of 100 game plays, the EGM may be configured to present 75 plays in the "wins 0" category, 15 plays in the "wins 1-20" category, ten plays in the "wins 21-50", four plays in the "wins 51-100", and one play in the "wins 100+" category. In other words, the category ranges of the categories are used as various target win ranges 412, and for any given game, one of the 100 game plays are selected (e.g., randomly, based on the percentages of each category, and "without replacement") to use as the target win range 412 for this particular game play. As such, the resultant RTP of those 100 games may satisfy or nearly satisfy the target RTP 312. If the resultant RTP of all 100 game plays does not quite satisfy the target RTP 312 (e.g., after all 100 games have been played), processor 204 may add additional game plays with lower- or higher-end games to shift the resultant RTP to satisfy the target RTP 312.

In the example embodiment, processor 204 selects a set of active symbols (e.g., as a potential active play area 322A) for potential presentation during this play (operation 430). Processor 204 uses this active play area 322A along with other potential inactive symbols 322B (e.g., as potential inactive symbols) to identify an initial symbol combination 452 to present to the player during this current play of the wagering game. More specifically, and for example, processor 204 may generate a reel spin of the virtual reels, or select various symbols to appear in each active display position of the active play area (e.g., based on a random number generator).

Using this active play area 322A, processor 204 then evaluates various inactive symbols 322B and associated potential outcomes that might occur. More specifically, processor 204 selects an inactive symbol (e.g., from an inactive symbol set) to display in a particular inactive display position (operation 440). In the example embodiment, processor 204 may iterate through all inactive symbols 322B within the inactive symbol set until processor 204 identifies inactive symbol(s) 322B that, in conjunction with active play area 322A and the player-initiated action allowed by the wagering game, generate potential outcomes that satisfy the target win range 412 for the current play of the game. More specifically, processor 204 determines potential outcomes for each possible replacement (e.g., as made possible by the player-initiated action) of the selected inactive symbol 322B within the active play area 322A (operation 442). In other words, and in an example where the player-initiated action allows the player to replace any active symbol in active play area 322A with the selected inactive symbol 322B, processor 204 individually simulates, for each active display position of the matrix, replacing the active symbol in that active display position with the selected inactive symbol 322B and determining an outcome of that altered play area (e.g., evaluating the altered play area based on a pay table of the wagering game to determine a credit award that would result from that altered play area).

Processor 204 ensures that the potential outcomes of the selected active play area 322A with the selected inactive symbol 322B satisfy the target win range 412. In other words, if all of the potential outcomes fall within the target win range 412, then the outcome of the game will fall within the target win range 412 on any of the possible actions taken by the player. If, at test 444, there is at least one potential outcome that does not satisfy the target win range 412, then processor 204 does not use the selected inactive symbol 322B. Upon failure of the selected inactive symbol 322B, processor 204 checks to see if there are any other potential inactive symbols that have not yet been tested for this particular active play area 322A. If, at test 448, there are no more potential inactive symbols 322B to evaluate, then processor 204 returns to operation 430 and selects a new set of active play area 322A, then continues to test various inactive symbols with that active play area 322A.

If, at test 444, all possible outcomes satisfy the target win range 412, then the selected inactive symbol 322B may be used for the current play of the game. At test 446, if the wagering game uses additional inactive symbols 322B (e.g., when multiple inactive display positions are provided), then processor 204 loops to operation 440 to select an inactive symbol 322B for another inactive display position. If no additional inactive symbols 322B are needed, then processor 204 displays the selected active play area 322A and inactive symbol(s) 322B of the initial symbol combination 452 to the player (e.g., as a simulated reel spin on the EGM) (operation 450). And similar to that described above, processor 204 allows the player to alter the active play area based on player input (operation 354) and evaluates the outcome of the wagering game based on the altered play area (operation 356).

Figure 5:
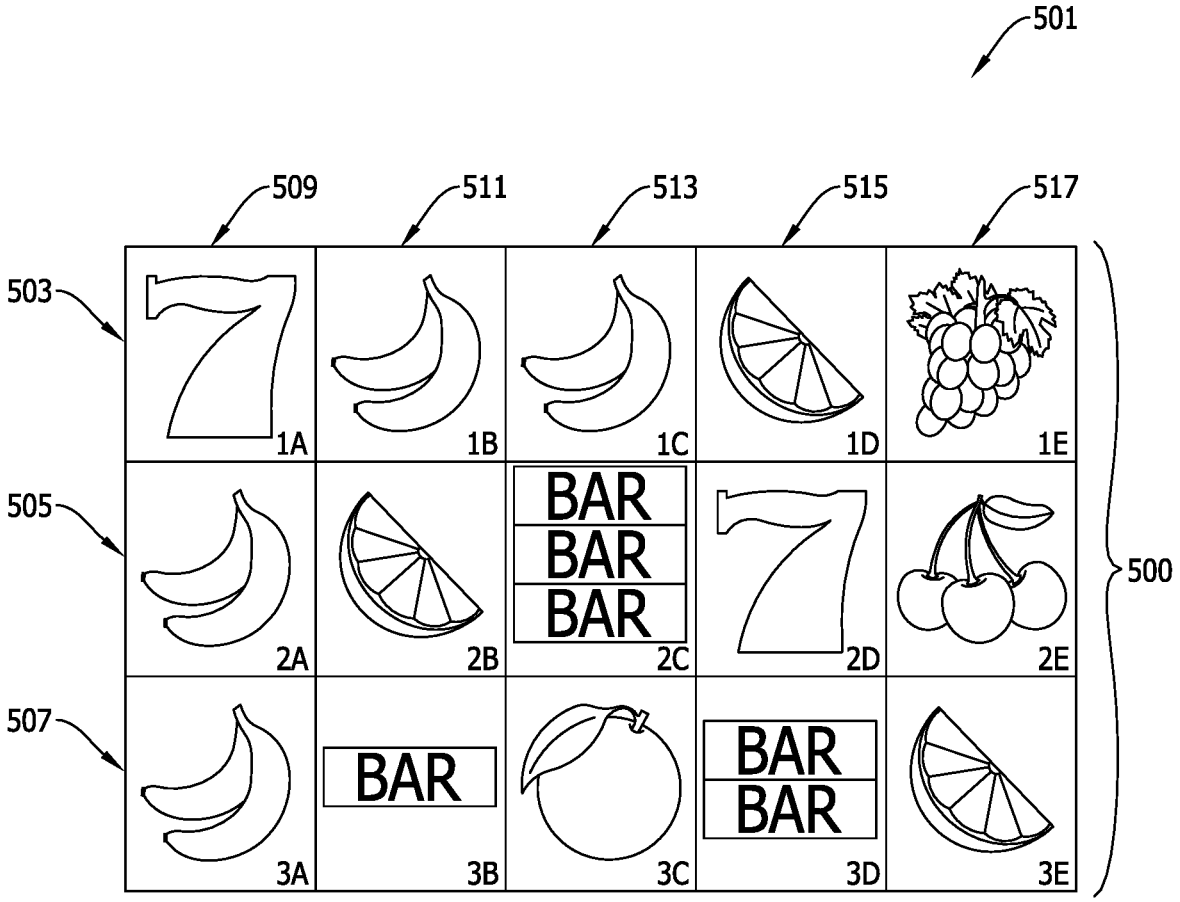
FIG. 5 is a schematic view of the skill-based wagering game described with respect to FIG. 3, in which an initial combination of symbols is displayed.

An example set of active symbols is shown in an active play area 500 in FIG. 5. The set of active symbols is displayed on the active play area 500, which may be presented as a set of virtual reels simulating mechanical reels (e.g., active play area 500 depicts a plurality of so-called "virtual reels"). As shown, active play area 500 includes a matrix of rows 503, 505, 507 and columns 509, 511, 513, 515, and 517, where each column may, in at least some embodiments, correspond to, and display symbols from, a corresponding reel strip (as described below), and where each display position in the active play area may be used to determine an outcome of the wagering game. In other words, the initial combination of symbols 500 may be selected from a plurality of reel strips corresponding to the plurality of columns 509-517.

In various embodiments, any suitable number of columns and rows may be displayed. Accordingly, in the exemplary embodiment, a plurality of symbol display positions, such as fifteen symbol display positions, are included in the matrix of rows 503-507 and columns 509-517. Each symbol display position is designated by a row number (e.g., 1, 2, and 3) and a column letter (e.g., A, B, C, D, and E). For example, the upper-left-most symbol display position, occurring at the intersection of row 503 and column 509, is designated by symbol display position "1A."

As shown, the initial combination of symbols is spread across three rows 503-507 and five columns 509-517. Thus, in the example embodiment, the initial combination of symbols includes fifteen distinct symbols in active play area 500. Those of skill will appreciate, however, that any suitable number of symbols may be displayed. For instance, in some embodiments, only three columns 509-513 of three symbols each may be displayed, for a total of nine simultaneously displayed symbols in active play area 500. Similarly, in some embodiments, five columns 509-517 of five symbols each may be displayed, for a total of twenty-five simultaneously displayed symbols.

Processor 204 may, in addition, display an option (e.g., on primary game display 240) to replace, or swap, one or more symbols from the initial combination of symbols with one or more inactive symbols. As described above, inactive symbols may include any number of symbols designated for use with the wagering game (e.g., during design of the wagering game). Accordingly, a player may select one or more symbols from the initial combination of symbols for replacement. In some embodiments, the player may also select one or more replacement symbols, such that a selected replacement symbol replaces or is swapped with a selected symbol from initial combination of symbols 500. In some embodiments, the player may select one or more rows that may be rotated, thereby altering the symbols in active play area 500. In some embodiments, the player may select two rows to swap, thereby altering the location of the symbols in active play area 500.

Similarly, in some embodiments, a player may select multiple symbols from initial combination of symbols 500 for swapping with multiple replacement symbols and/or for swapping with multiple other symbols from initial combination of symbols 500. For example, a player may select a first symbol from initial combination of symbols 500 and a second symbol from initial combination of symbols 500, and processor 204 may swap the first symbol with the second symbol and vice versa, such that a modified combination of symbols is displayed, in which the first symbol occupies the previous location of the second symbol and vice versa. In such an embodiment, a player's credit balance may be debited after each symbol swap and/or after a plurality of symbol swaps.

In the example embodiment, the player may review and/or consult a paytable of the wagering game prior to selecting a player-initiated action. Specifically, the player may use the paytable to consider player-initiated action options (e.g., to select a replacement symbol that optimizes or maximizes an award in the wagering game). However, the player may in fact select a player-initiated action that results in less than a maximum award and/or, in some cases, even in no award whatsoever. Thus, the player is permitted to exercise some skill during selection of a player-initiated action (e.g., based on the player's evaluation of the paytable). Finally, in some embodiments, processor 204 may (e.g., at the player's request) implement an auto-play option, which may automatically select an optimal player-initiated action.

Where multiple player-initiated actions (e.g., symbol swaps) are permitted by the wagering game, processor 204 may require that a player use all available player-initiated actions and/or, in some cases, a player may be permitted to use only a portion of an available player-initiated actions. Similarly, in at least some embodiments, processor 204 may award one or more additional player-initiated actions based on an outcome of a base game and/or a bonus game of the wagering game. For example, processor 204 may award one or more additional swaps if initial combination of symbols 500 triggers one or more awards based on a paytable of the wagering game.

In some embodiments, for situations in which the active play area 500 includes at least one winning combination, a portion of the RTP in the wagering game (e.g., the portion associated with the award resulting from initial combination of symbols 500) may be luck-based. Thus, in some embodiments, RTP may be luck-based as well as skill-based, such that a portion of the RTP is derived from an outcome in a base or bonus game (the luck-based portion), and a portion of the RTP is derived, as described herein, from an action taken by a player, such as swapping or replacing a symbol in initial combination of symbols 500.

Likewise, in some embodiments, a player may select one or more symbols to swap between one or more game areas, such as, for example, where a replacement symbol is displayed in one game area and initial combination of symbols 500 is displayed in another game area (e.g., active play area 500). Further, in at least some embodiments, one or more replacement symbols may be displayed outside a game area, and a player may select the one or more replacement symbols, such that the one or more replacement symbols are swapped with one or more other symbols from the initial combination of symbols. For example, in at least some embodiments, the initial combination of symbols may be displayed on primary game display 240, and one or more replacement symbols may be displayed on buttons 122 (e.g., where buttons 122 includes an LCD display).

Figure 8A:
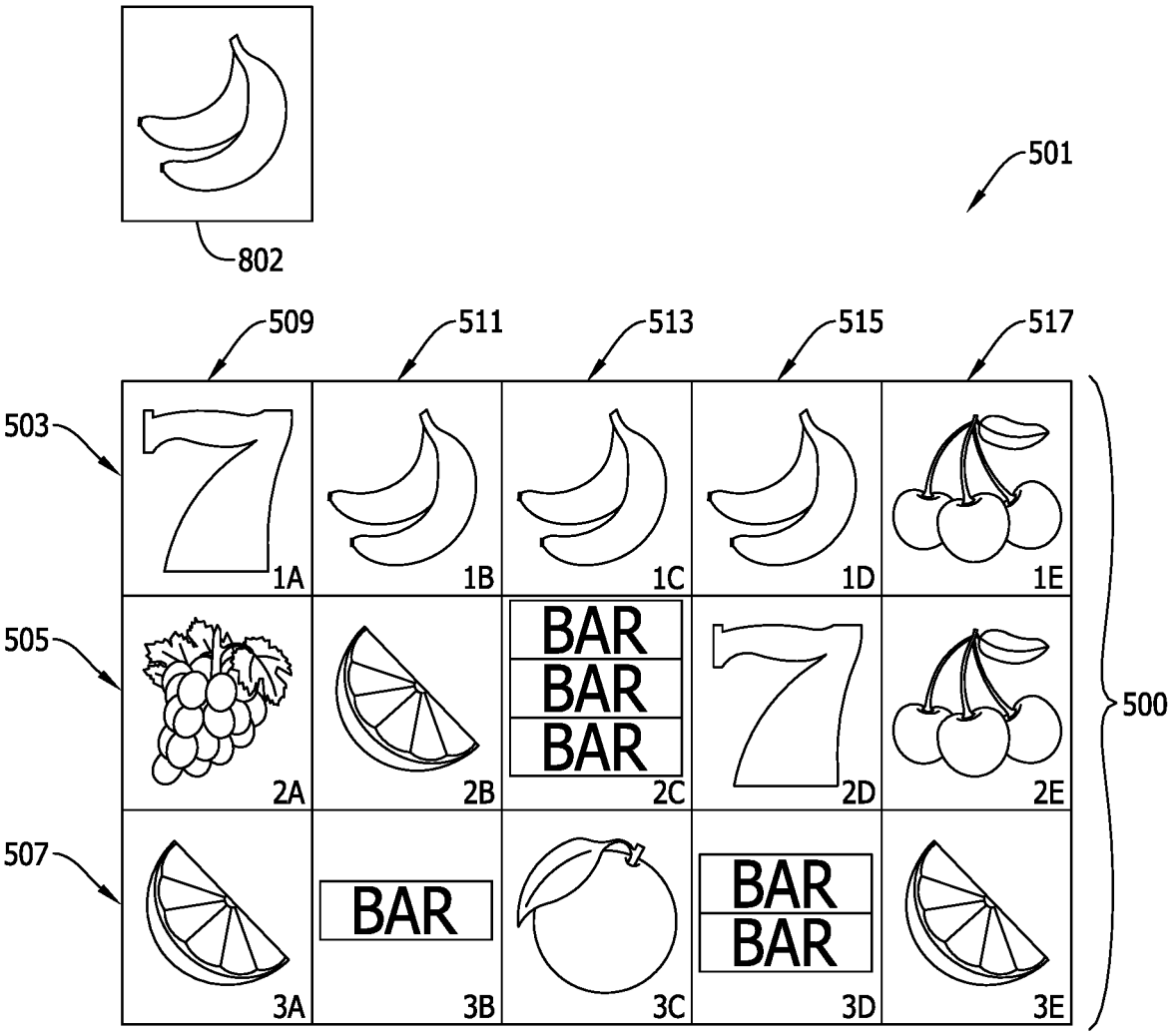
FIG. 8A is a schematic view of the skill-based wagering game described with respect to FIG. 3, in which a player is shown an option to swap a symbol displayed outside a game area into the initial combination of symbols shown at FIG. 5 to create a modified symbol combination.
Figure 8B:
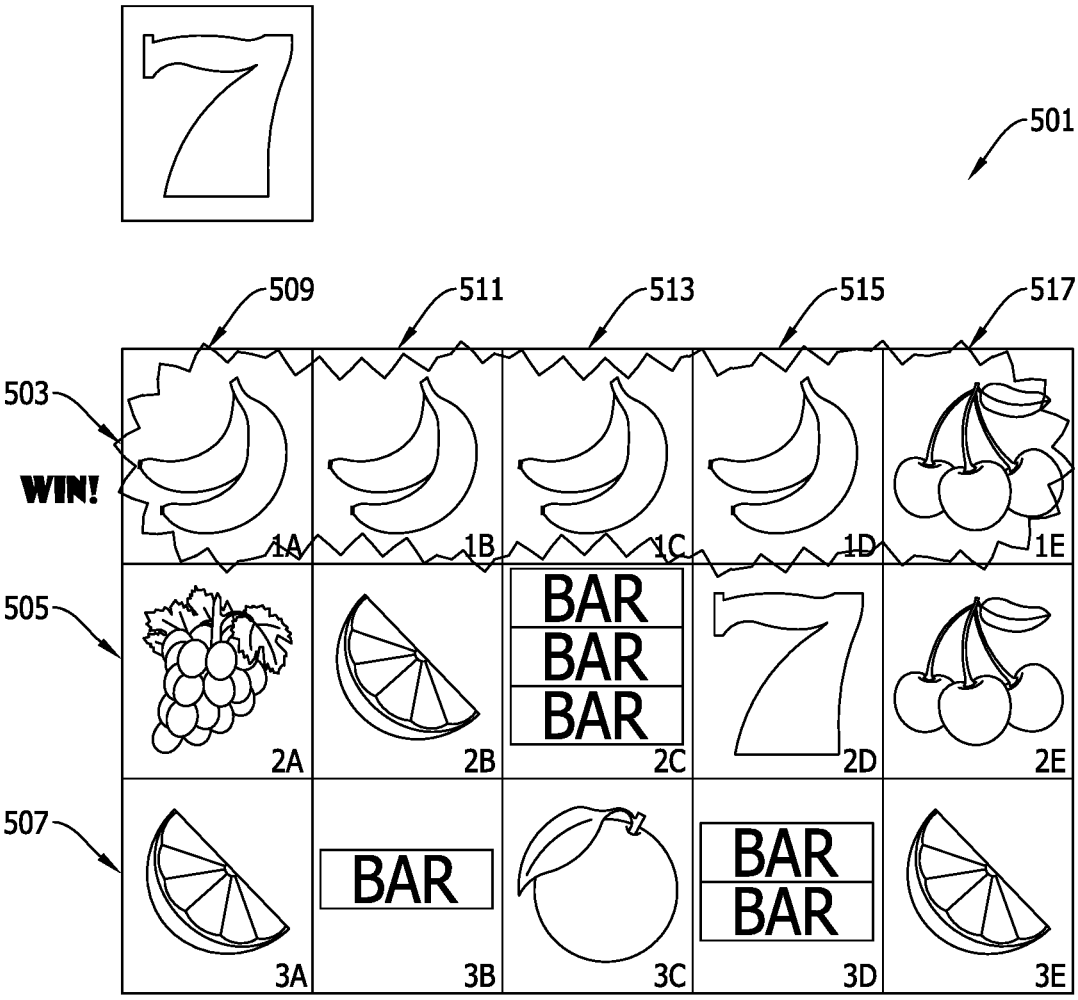
FIG. 8B is a schematic view of the skill-based wagering game described with respect to FIG. 3, in which a player swaps a symbol displayed outside the game area shown at FIG. 8A into the initial combination of symbols to create the modified symbol combination.

An example in which a player is provided a player-initiated action to swap a replacement symbol displayed outside active play area 500 into the matrix displaying the initial combination of symbols is shown at FIG. 8A, and an example in which the player has selected the replacement symbol displayed outside active play area 500, is depicted at FIG. 8B. In some embodiments, methods 300 and 400 may be used to present the example game shown in FIGS. 8A and 8B. As shown, an inactive symbol 802 is displayed outside game area 500. The player may select inactive symbol 802 using any means described herein (e.g., via touchscreen display and/or via a button deck, press, drag, and release). In addition, the player may select a symbol, such as the symbol displayed at symbol display position 1A, from initial combination of symbols to be swapped out of the matrix (e.g., targeting symbol display position 1A as the destination for inactive symbol 802). In response, processor 204 may swap inactive symbol 802 into the matrix at symbol display position 1A to create a winning combination of symbols in column 509 (e.g., three banana symbols).

In addition, in some embodiments, a player may select one or more columns 509-517 and/or one or more rows 503-507 to swap or replace with one or more other columns 509-517 and/or one or more rows 503-507. For example, a player may select column 509 and column 511 for swapping. In response, processor 204 may swap column 509 with column 511 (e.g., processor 204 may swap the symbols displayed on column 509 with each adjacent symbol displayed on column 511).

Figure 7A:
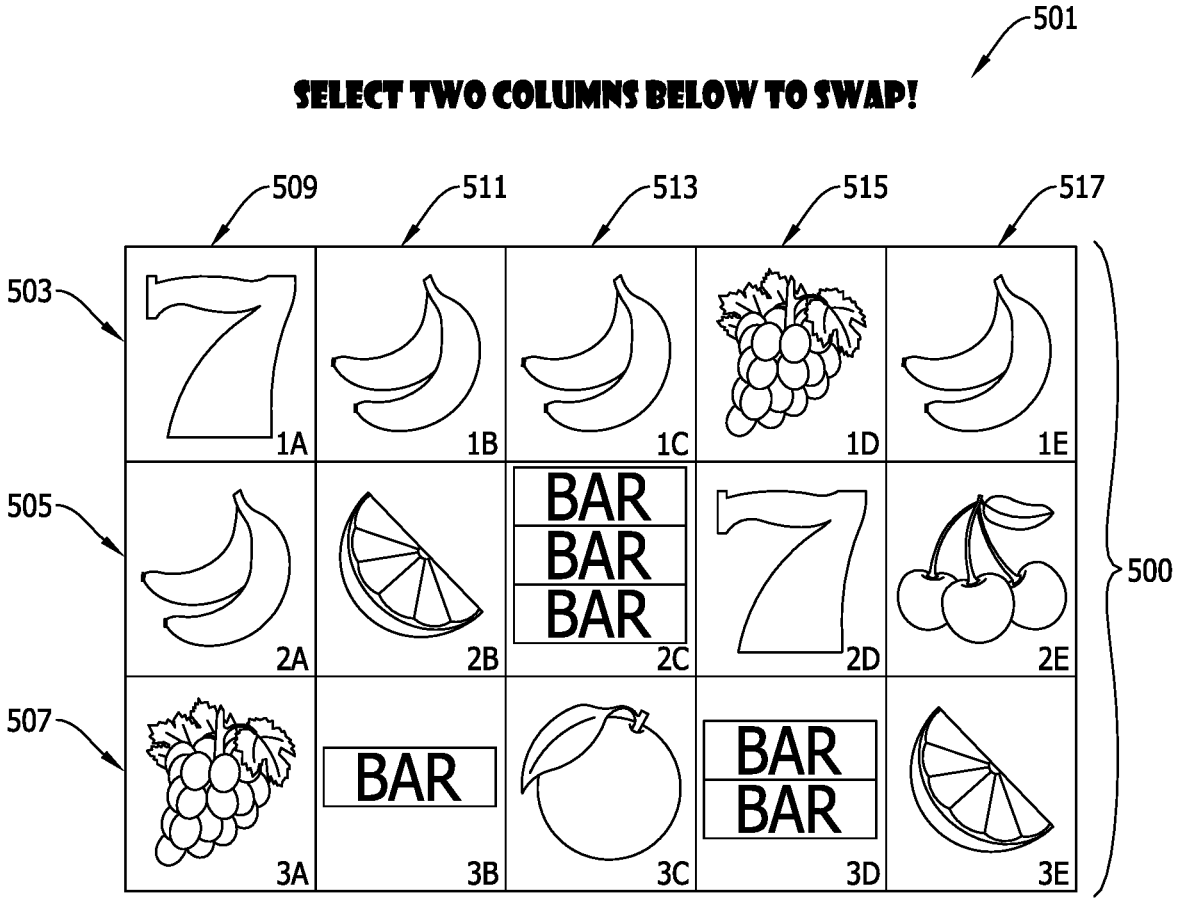
FIG. 7A is a schematic view of the skill-based wagering game described with respect to FIG. 3, in which a player is shown an option to swap one column of symbols with another column of symbols from the initial combination of symbols to create a modified symbol combination.
Figure 7B:
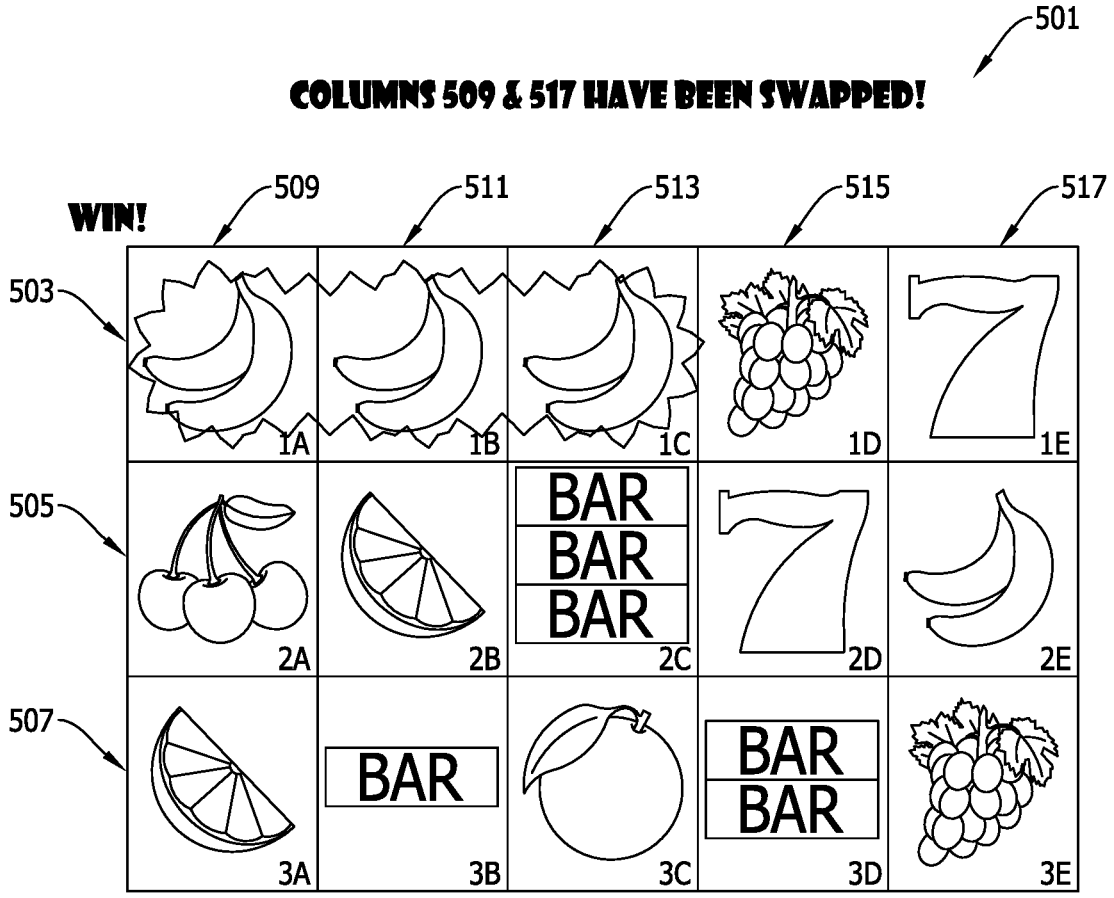
FIG. 7B is a schematic view of the skill-based wagering game described with respect to FIG. 3, in which a player swaps one column of symbols with another column of symbols from the initial combination of symbols shown at FIG. 7A to create the modified symbol combination.

An example in which a player is provided a player-initiated action to swap columns is shown at FIG. 7A, and an example in which the player has swapped first column 509 with fifth column 517 is depicted at FIG. 7B. In some embodiments, methods 300 and 400 may be used to present the example game shown in FIGS. 7A and 7B. As shown, the symbol at symbol display position 1A has been swapped with the symbol at symbol display position 1E, and vice versa. Similarly, the symbol at symbol display position 2A has been swapped with the symbol at symbol display position 2E, and vice versa. Likewise, the symbol at symbol display position 3A has been swapped with the symbol at symbol display position 3E, and vice versa. In the example, the column swap results, as shown, in a win line spanning symbol display positions 1A, 1B, and 1C (e.g., three collinear banana symbols). Thus, the symbols at one column (e.g., column 509) may be selected by a player and swapped with the symbols at another column (e.g., column 517). In addition, the same operation may be performed on any of rows 503-507.

Further, in at least one embodiment, one or more symbols of the initial combination of symbols may be geometrically shaped, such as, for example, like a puzzle piece, and a shaped replacement symbol may be displayed and/or otherwise provided to the player for placement within the initial combination of symbols. For instance, a shaped replacement symbol may be provided to the player, and the player may be permitted to place the shaped replacement symbol at one or more locations within the initial combination of symbols. In some cases, the player may also be permitted to rotate, flip, and/or otherwise manipulate a position, location, and/or orientation of the replacement symbol.

In addition, in some embodiments, a player may select one or more symbols from initial combination of symbols to "activate." For example, an "inactive" symbol may be displayed with the initial combination of symbols, such as in conjunction with an "active" symbol, where the distinction between an active symbol and an inactive symbol is only that an active symbol contributes to an award determination (as described herein), while an inactive symbol does not contribute to the award determination. Thus, the player may select an inactive symbol, and in response, processor 204 may activate the selected inactive symbol. Processor 204 may also deactivate an active symbol, such that the active symbol is effectively replaced by the inactive symbol.

Moreover, in at least some embodiments, a player may select one or more symbols from the initial combination of symbols to "duplicate" a symbol from the initial combination of symbols into another location in the combination. For example, one or more symbols of the initial combination of symbols may be displayed in conjunction with an index and/or indicia, such that selection of the symbol for duplication results in duplication or copying of the symbol over one or more other symbols from the initial combination of symbols. In one example embodiment, an index may indicate a number of symbol positions to the left, right, above, and/or below the selected symbol. In response to selection of a symbol with such an index, processor 204 may duplicate or copy the symbol over another symbol positioned the specified number of symbol positions to the left, right, above, and/or below the selected symbol.

Further, in some embodiments, a "tumbling mechanic" may be added to any of the symbol replacement options described above. For example, a tumbling mechanic that previews one or more available replacement symbols for a player prior to selection by the player may be added to the wagering game. More particularly, a tumbling mechanic may function such that a one or more additional and/or replacement symbols previewed outside a game area can be selected by a player. When one or more additional and/or replacement symbols are selected by the player, the selected symbol or symbols may be introduced in the game area, such as, for example, to replace symbols that previously formed all or a portion of a winning combination of symbols. In other words, one or more symbols forming a winning combination of symbols may be swapped out, in response to a player selection, for one or more additional and/or replacement symbols appearing or previewed outside the active play area. When these symbols are added to the game area, one or more additional winning combinations of symbols may be formed for additional awards.

In addition, in the example embodiment, a player may select a player-initiated action to rotate one or more columns 509-517 forward or backward (e.g., down or up, respectively) by a specified number of symbol display positions. In practical terms, this may be achieved by displaying a first row of inactive symbols in a top row above the matrix of symbol display positions and/or a second row of replacement symbols in a bottom row below the matrix of symbol display positions. The player may select a symbol from the top row and/or the bottom row, such that at least one column 509-517 appears to move vertically (e.g., up or down) and/or such that the selected symbol is simply swapped into the matrix, or such that the reel appears to rotate in the particular direction. Additional rows of replacement symbols may be added at the top and bottom of the matrix to enable a player to move columns 509-517 up and down by more than a single symbol display position.

Figure 6A:
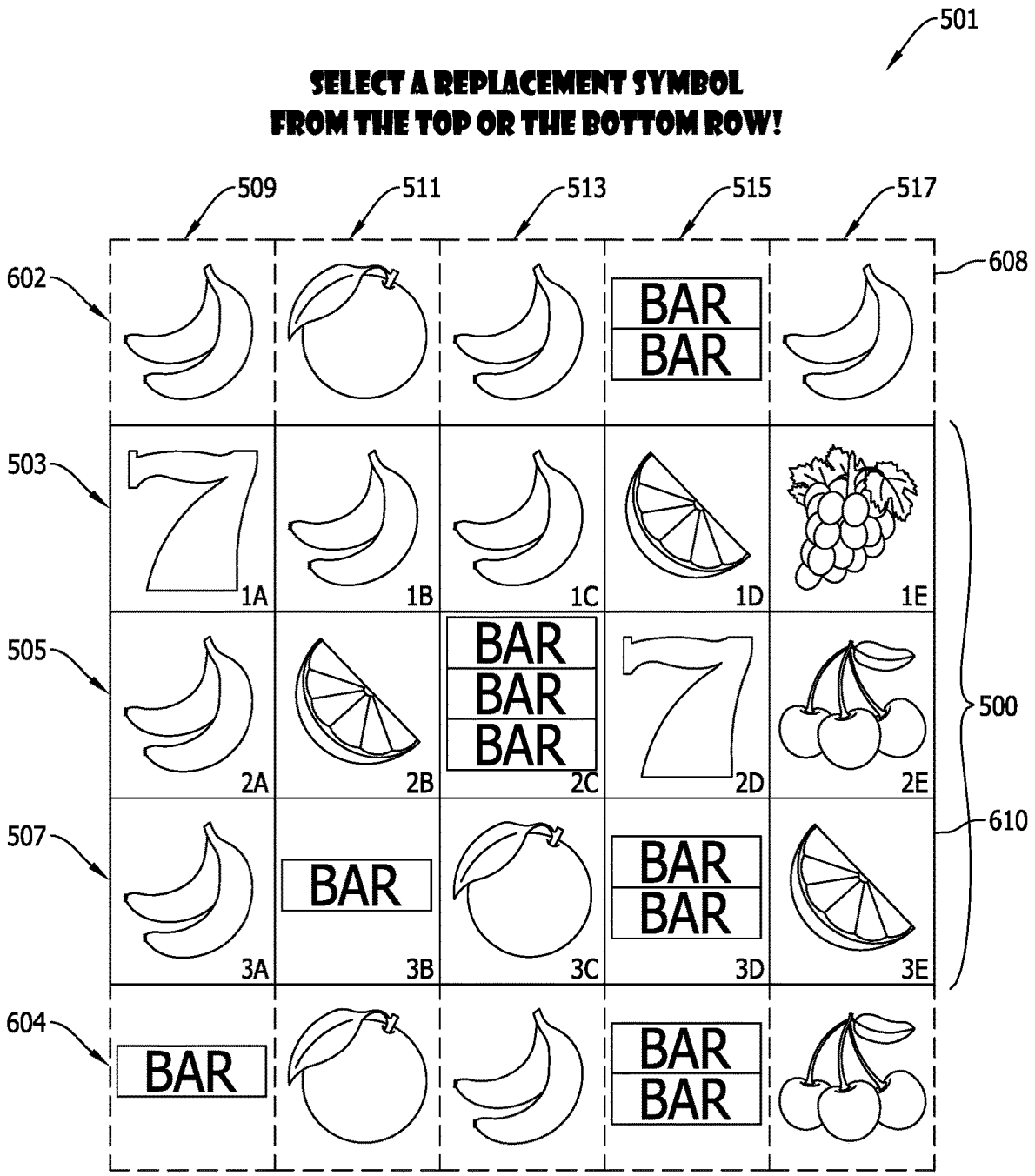
FIG. 6A is a schematic view of the skill-based wagering game in which a player is shown an option to swap a symbol from a top row or a bottom row for a symbol from the initial combination of symbols shown at FIG. 5 to create a modified symbol combination.
Figure 6B:
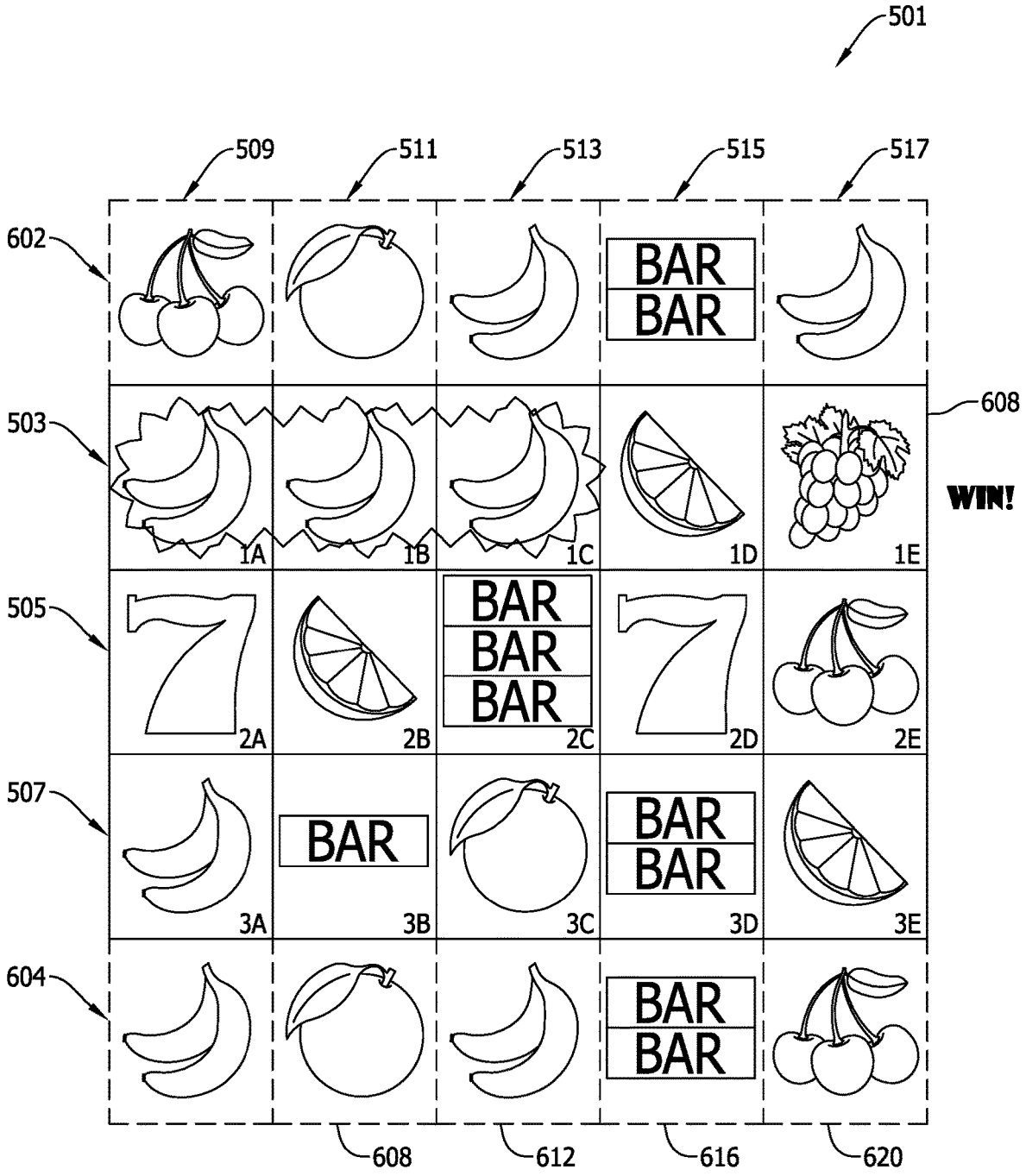
FIG. 6B is a schematic view of the skill-based wagering game in which a player swaps a symbol from the top row or the bottom row shown at FIG. 5B to create the modified symbol combination.

An example in which a player is provided a player-initiated action to select a replacement symbol from a top row 602 or a bottom row 604 (e.g., an option to rotate a reel forward or backward) is shown at FIG. 6A, and an example in which the player has selected a symbol from top row 602 is shown with respect to FIG. 6B. In some embodiments, methods 300 and 400 may be used to present the example game shown in FIGS. 6A and 6B. As described above, the top row 602 may include a plurality of inactive symbols (e.g., replacement symbols) above and adjacent row 503 of the matrix, and the bottom row 604 may include a plurality of inactive symbols (e.g., replacement symbols) below and adjacent row 507 of the matrix. In some embodiments, the inactive symbols are determined from the reels of the wagering game.

The player selects one inactive symbol from the top row 602 or the bottom row 604, and processor 204 swaps the selected replacement symbol into an adjacent symbol display position within the matrix. Specifically, in the example shown, the player has selected inactive symbol as the "banana" above symbol display position 1A for swapping. In some embodiments, the player may touch the inactive display position, or press-and-drag the inactive symbol down or up, or into a particular active display position such as position 1A. As the selected inactive symbol is swapped into an adjacent symbol display position 1A within the matrix, the symbols occupying the column 509 into which the inactive symbol was swapped appear to move vertically, up or down, such that an active symbol from the initial combination of symbols originally occupying the matrix at symbol display position 3A is shifted out of the matrix. In some embodiments, the player selects a particular reel (e.g., a particular column) and the reel is rotated to move the inactive symbol into active play area 500. In some embodiments, the player may also identify a direction of rotation (e.g., by pressing and dragging the reel up or down) and the reel is rotated in the identified direction. In some embodiments, the selected inactive symbol replaces an active symbol (e.g., without changing the rest of the matrix).

Although only two rows of replacement symbols are shown for each column 509-517 (one above and one below), in various embodiments, any suitable number of rows of replacement symbols may be displayed above and/or below each column 509-517. For example, in some embodiments, four rows of replacement symbols (e.g., two above and two below) may be displayed. Moreover, although replacement symbols are displayed in association with each column 509-517 in the illustrated example, in other embodiments, replacement symbols may be selectively displayed in association with fewer than all columns 509-517 and/or in association with any of rows 503-507.

Embodiments of the present disclosure thus relate to a skill-based electronic wagering game, in which a player interacts with an initial combination of symbols to replace one or more symbols from the initial combination with one or more replacement symbols. Specifically, a player may be provided one or more symbol replacement options, such as, for example, an option to swap one symbol with another symbol. The player may, in addition, refer to a paytable of the wagering game prior to selecting a symbol replacement option, such that the player's skill in selecting a replacement symbol contributes a skill-based gameplay component to the wagering game.

In addition, to control an average RTP of the wagering game, a computer processor of the wagering game may simulate a plurality of modified symbol combinations that may be reached, with the addition of one or more player selected replacement symbols, from the initial combination of symbols. The plurality of modified symbol combinations are evaluated, and a subset of symbol combinations is selected from the plurality of modified symbol combinations, such that an average minimum award associated with the subset of symbol combinations is greater than a first threshold value, and such that an average maximum award associated with the subset of symbol combinations is less than a second threshold value. Finally, the initial combination of symbols presented to the player for modification by a replacement symbol may be limited to an initial combination of symbols associated with a modified symbol combination in the subset.

As indicated above, the process may be embodied in computer software. The computer software could be supplied in a number of ways, for example on a tangible, non-transitory, computer readable storage medium, such as on any nonvolatile computer memory device. Further, different parts of the computer software can be executed by different devices, such as, for example, in a client-server relationship. Persons skilled in the art will appreciate that computer software provides a series of instructions executable by the processor.

Example embodiments and related components are described above in detail. The disclosure is not limited to the specific embodiments described herein, but rather, components of the systems and/or articles and/or steps of the methods may be utilized independently and separately from other components and/or steps described herein. For example, the configuration of components described herein may also be used in combination with other processes, and is not limited to practice with the systems, articles, and related methods as described herein. Rather, the example embodiment can be implemented and utilized in connection with many applications in which a skill-based wagering game is desired.

Although specific features of various embodiments of the present disclosure may be shown in some drawings and not in others, this is for convenience only. In accordance with the principles of the present disclosure, any feature of a drawing may be referenced and/or claimed in combination with any feature of any other drawing.

This written description uses examples to disclose the embodiments of the present disclosure, including the best mode, and also to enable any person skilled in the art to practice the disclosure, including making and using any devices or systems and performing any incorporated methods. The patentable scope of the embodiments described herein is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. An electronic gaming system comprising:

a memory; and a processor configured to execute instructions stored in the memory, which when executed, cause the processor to:

cause display of an active play area and an inactive display position, the active play area including a matrix of display positions for displaying a plurality of active symbols, the inactive display position for displaying an inactive symbol;

select a plurality of active symbols for display in the active play area for a game instance;

determine a target win range that indicates a range of outcomes for the game instance, wherein the target win range contributes to satisfying a configured return-to-player (RTP) of the electronic gaming system over a plurality of game instances;

select the inactive symbol for display in the inactive display position by (i) determining potential outcomes for each possible replacement of the plurality of active symbols by the inactive symbol, and (ii) checking that the determined potential outcomes satisfy the target win range;

receive the player input indicating which displayed active symbol is to be replaced by the inactive symbol;

cause display of the inactive symbol replacing the indicated active symbol in the active play area in response to the player input, resulting in an altered active play area; and evaluate an outcome of the game instance based on the altered active play area.

2. The electronic gaming system of claim 1, wherein determining potential outcomes for each possible replacement of the plurality of active symbols by the inactive symbol includes:

identifying a plurality of prospective symbols to provide as the inactive symbol in the inactive display position; and evaluating, for each prospective symbol of the plurality of prospective symbols, a plurality of potential credit awards, each potential credit award being determined using the selected plurality of active symbols being modified with the prospective symbol.

3. The electronic gaming system of claim 2, wherein evaluating a plurality of potential credit awards includes, for each prospective symbol of the plurality of prospective symbols:

identifying a prospective symbol from the plurality of prospective symbols;

determining a plurality of potential moves available to the player based on the player input;

determining, for each potential move of the plurality of potential moves, an altered matrix based on the potential move and the prospective symbol; and evaluating the altered matrix, thereby generating a potential credit award of the plurality of potential credit awards.

4. The electronic gaming system of claim 2, wherein the player input is based on a player moving the inactive symbol into a destination display position within the active play area, and wherein the determining potential outcomes includes evaluating moving the inactive symbol to each active display position within the matrix.

5. The electronic gaming system of claim 2, wherein the player input includes a player identified destination symbol position within the active play area, and wherein the player input is based on a player replacing an active symbol in the destination symbol position with the inactive symbol.

6. The electronic gaming system of claim 1, wherein the inactive display position includes a row of inactive display positions for display adjacent to the matrix.

7. The electronic gaming system of claim 6, wherein the row of inactive display positions is configured for display above the matrix of display positions, and wherein the player input is received at a display in communication with the processor based on a player sliding a selected column of the matrix, thereby sliding an inactive symbol from the row of inactive display positions into the active play area, and sliding an active symbol of the selected column out of the active play area on the display.

8. The electronic gaming system of claim 1, wherein the inactive display position is caused to be displayed at a position spaced from and not adjacent to the matrix on a remote display.

9. The electronic gaming system of claim 1, wherein the target win range is selected from a predetermined plurality of grouped win ranges.

10. The electronic gaming system of claim 9, wherein the target win range is selected randomly from the plurality of grouped win ranges.

11. The electronic gaming system of claim 9, wherein the plurality of grouped win ranges includes at least four different categories of win ranges.

12. The electronic gaming system of claim 1, wherein the configured RTP is at least partially derived from a base game or bonus game and at least partially derived from the received player input.

13. A non-transitory computer-readable medium containing instructions embodied thereon, which when executed by a processor, cause the processor to:

cause display of an active play area and an inactive display position for use in game play, the active play area including a matrix of display positions for displaying a plurality of active symbols, the inactive display position for displaying an inactive symbol;

select a plurality of active symbols for display in the active play area for a game instance;

determine a target win range that indicates a range of outcomes for the game instance, wherein the target win range contributes to satisfying a configured return-to-player (RTP) over a plurality of game instances;

select the inactive symbol for display in the inactive display position by (i) determining potential outcomes for each possible replacement of the plurality of active symbols by the inactive symbol, and (ii) checking that the determined potential outcomes satisfy the target win range;

receive the player input from a remote gaming display, the player input indicating which displayed active symbol is to be replaced by the inactive symbol;

cause display of the inactive symbol replacing the indicated active symbol in the active play area in response to the player input, resulting in an altered active play area; and evaluate an outcome of the game instance based on the altered active play area.

14. The non-transitory computer-readable medium of claim 13, wherein determining potential outcomes for each possible replacement of the plurality of active symbols by the inactive symbol includes:

identifying a plurality of prospective symbols to provide as the inactive symbol in the inactive display position; and evaluating, for each prospective symbol of the plurality of prospective symbols, a plurality of potential credit awards, each potential credit award being determined using the selected plurality of active symbols being modified with the prospective symbol.

15. The non-transitory computer-readable medium of claim 14, wherein evaluating a plurality of potential credit awards includes, for each prospective symbol of the plurality of prospective symbols:

identifying a prospective symbol from the plurality of prospective symbols;

determining a plurality of potential moves available to the player based on the player input;

determining, for each potential move of the plurality of potential moves, an altered matrix based on the potential move and the prospective symbol; and evaluating the altered matrix, thereby generating a potential credit award of the plurality of potential credit awards.

16. The non-transitory computer-readable medium of claim 14, wherein the player input is based on a player moving the inactive symbol into a destination display position within the active play area, and wherein the determining potential outcomes includes evaluating moving the inactive symbol to each active display position within the matrix.

17. The non-transitory computer-readable medium of claim 14, wherein the player input includes a player identified destination symbol position within the active play area, and wherein the player input is based on a player replacing an active symbol in the destination symbol position with the inactive symbol.

18. The non-transitory computer-readable medium of claim 13, wherein the inactive display position includes a row of inactive display positions for display adjacent to the matrix.

19. The non-transitory computer-readable medium of claim 18, wherein the row of inactive display positions is configured for display above the matrix of display positions, and wherein the player input is received at a display in communication with the processor based on a player sliding a selected column of the matrix, thereby sliding an inactive symbol from the row of inactive display positions into the active play area and sliding an active symbol of the selected column out of the active play area on the display.

20. A method for providing a game on an electronic gaming system comprising the steps of:

causing display of an active play area and an inactive display position, the active play area including a matrix of display positions for displaying a plurality of active symbols, the inactive display position for displaying an inactive symbol;

selecting a plurality of active symbols for display in the active play area for a game instance;

determining a target win range that identifies a range of allowable outcomes for the game instance, wherein the target win range contributes to satisfying a configured return-to-player (RTP) of the electronic gaming system over a plurality of game instances;

selecting the inactive symbol for display in the inactive display position by (i) determining potential outcomes for each possible replacement of the plurality of active symbols by the inactive symbol, and (ii) checking that the determined potential outcomes satisfy the target win range;

receiving the player input indicating which displayed active symbol is to be replaced by the inactive symbol;

causing display of the inactive symbol replacing the indicated active symbol in the active play area in response to the player input, resulting in an altered active play area; and evaluating an outcome of the game instance based on the altered active play area.

* * * * *